US008864134B2

(12) United States Patent
Tachibana

(10) Patent No.: US 8,864,134 B2
(45) Date of Patent: Oct. 21, 2014

(54) IMAGE FORMING APPARATUS, METHOD OF CONTROLLING IMAGE FORMING APPARATUS, AND STORAGE MEDIUM

(75) Inventor: Yoshiro Tachibana, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

(21) Appl. No.: 12/636,468

(22) Filed: Dec. 11, 2009

(65) Prior Publication Data

US 2010/0148421 A1 Jun. 17, 2010

(30) Foreign Application Priority Data

Dec. 17, 2008 (JP) ..... 2008-321647

(51) Int. Cl.

| | |
|---|---|
| ***B65H 39/10*** | (2006.01) |
| ***B65H 31/22*** | (2006.01) |
| ***B65H 29/04*** | (2006.01) |
| ***B65H 31/10*** | (2006.01) |
| ***B65H 31/20*** | (2006.01) |
| ***B65H 31/24*** | (2006.01) |
| ***B65H 31/34*** | (2006.01) |
| ***B65H 31/36*** | (2006.01) |
| ***G03G 15/00*** | (2006.01) |

(52) U.S. Cl.

CPC ..... *B65H 31/22* (2013.01); *B65H 29/041* (2013.01); *B65H 31/10* (2013.01); *B65H 31/20* (2013.01); *B65H 31/24* (2013.01); *B65H 31/34* (2013.01); *B65H 31/36* (2013.01); *G03G 15/6538* (2013.01); *B65H 2301/42252* (2013.01); *B65H 2405/15* (2013.01); *B65H 2511/10* (2013.01); *B65H 2511/51* (2013.01); *B65H 2511/515* (2013.01); *B65H 2551/00* (2013.01); *B65H 2557/65* (2013.01); *B65H 2801/06* (2013.01); *G03G 2215/00059* (2013.01); *G03G 2215/0129* (2013.01)

USPC ..... 271/299; 271/279; 271/288; 271/298

(58) Field of Classification Search

USPC ..... 271/279, 287, 288, 298–300, 9.12

See application file for complete search history.

(56) References Cited

U.S. PATENT DOCUMENTS

| | | | | |
|---|---|---|---|---|
| 3,907,274 | A * | 9/1975 | D'Amato et al. | 271/300 |
| 5,284,339 | A * | 2/1994 | van Opstal et al. | 271/288 |
| 5,931,464 | A * | 8/1999 | Shimizu et al. | 271/296 |
| 6,234,474 | B1 * | 5/2001 | Horii et al. | 271/288 |
| 6,246,926 | B1 * | 6/2001 | Ishii et al. | 700/223 |
| 6,788,426 | B1 * | 9/2004 | Yamanaka et al. | 358/1.15 |

(Continued)

FOREIGN PATENT DOCUMENTS

| | | |
|---|---|---|
| CN | 101139053 A | 3/2008 |
| CN | 101139054 A | 3/2008 |
| JP | 2008-087965 A | 4/2008 |

*Primary Examiner* — Prasad Gokhale

(74) *Attorney, Agent, or Firm* — Canon U.S.A., Inc. IP Division

(57) ABSTRACT

A reduction is prevented in stacking efficiency of a sheet stacking apparatus due to a wrong setting of a stacking tray performed by a user thereby achieving a high stacking efficiency. In a control method for controlling an image forming apparatus including a sheet stacking control unit configured to stack sheets, subjected to printing in a print job, on one of a plurality of removable sheet stacking units, the control method includes specifying a sheet discharging unit used in the print job, determining whether a sheet stacking unit corresponding to the specified sheet discharging unit is properly set, and, in a case where it is determined that the sheet stacking unit is not properly set, restricting conveying sheets to the sheet stacking unit.

16 Claims, 17 Drawing Sheets

(56) References Cited

U.S. PATENT DOCUMENTS

| | | | | |
|---|---|---|---|---|
| 7,231,171 | B2 * | 6/2007 | Shibata et al. | 399/367 |
| 7,469,896 | B2 * | 12/2008 | Sato et al. | 271/287 |
| 8,282,098 | B2 * | 10/2012 | Hayashi et al. | 271/289 |
| 2008/0054557 | A1 * | 3/2008 | Hayashi et al. | 271/279 |
| 2008/0054558 | A1 | 3/2008 | Obuchi | |
| 2009/0224468 | A1 * | 9/2009 | Fukatsu et al. | 271/279 |
| 2010/0320679 | A1 * | 12/2010 | Miyake et al. | 271/298 |
| 2010/0320680 | A1 * | 12/2010 | Brewer, III | 271/303 |

* cited by examiner

| |
|---|
| FIG. 6A |
| FIG. 6B |

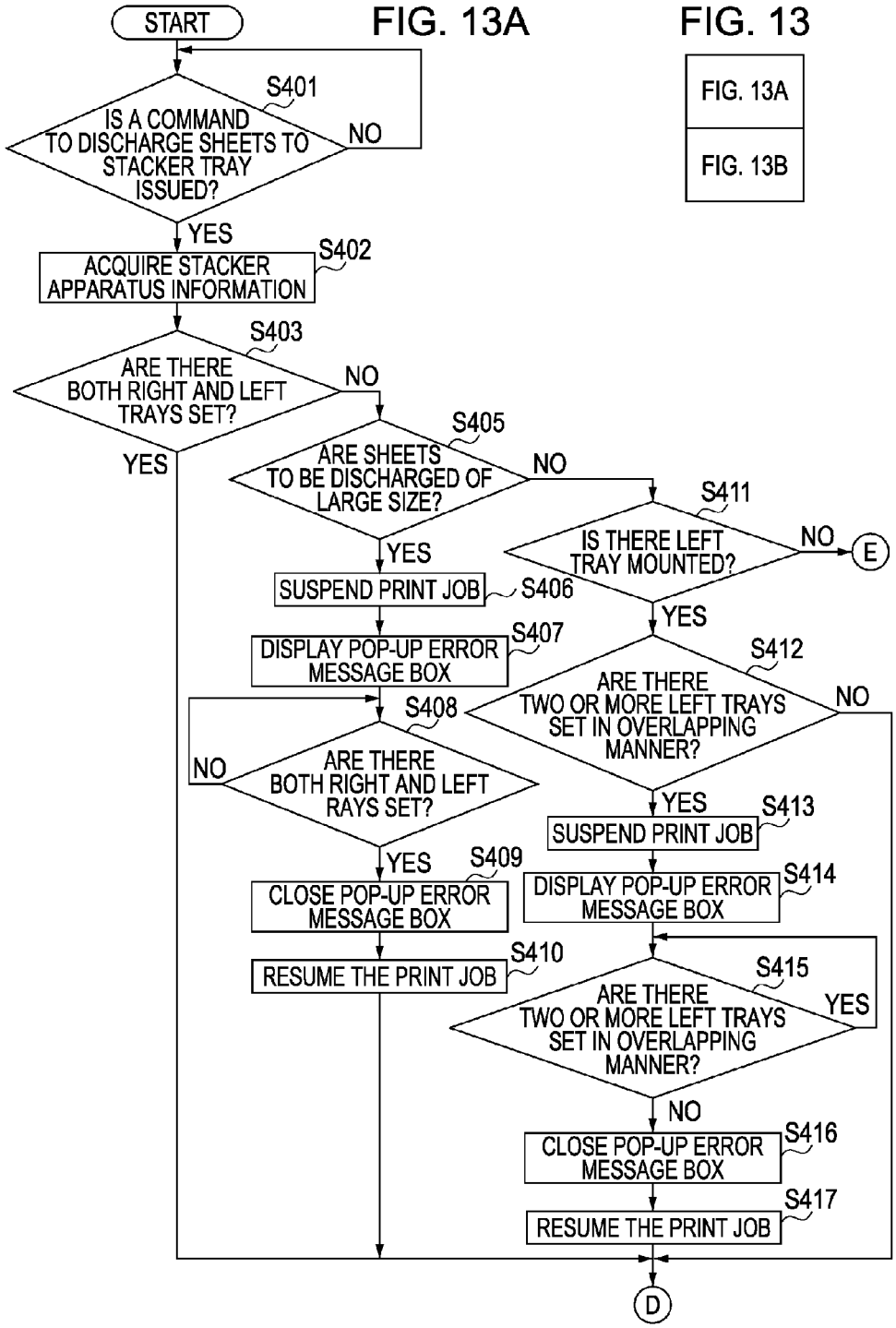
START
FIG. 13A
FIG. 13
FIG. 13A
FIG. 13B
S401
IS A COMMAND TO DISCHARGE SHEETS TO STACKER TRAY ISSUED?
NO
YES
S402
ACQUIRE STACKER APPARATUS INFORMATION
S403
ARE THERE BOTH RIGHT AND LEFT TRAYS SET?
NO
YES
S405
ARE SHEETS TO BE DISCHARGED OF LARGE SIZE?
NO
YES
S406
SUSPEND PRINT JOB
S407
DISPLAY POP-UP ERROR MESSAGE BOX
S408
ARE THERE BOTH RIGHT AND LEFT RAYS SET?
NO
YES
S409
CLOSE POP-UP ERROR MESSAGE BOX
S410
RESUME THE PRINT JOB
S411
IS THERE LEFT TRAY MOUNTED?
NO
E
YES
S412
ARE THERE TWO OR MORE LEFT TRAYS SET IN OVERLAPPING MANNER?
NO
YES
S413
SUSPEND PRINT JOB
S414
DISPLAY POP-UP ERROR MESSAGE BOX
S415
ARE THERE TWO OR MORE LEFT TRAYS SET IN OVERLAPPING MANNER?
YES
NO
S416
CLOSE POP-UP ERROR MESSAGE BOX
S417
RESUME THE PRINT JOB
D

IMAGE FORMING APPARATUS, METHOD OF CONTROLLING IMAGE FORMING APPARATUS, AND STORAGE MEDIUM

BACKGROUND OF THE INVENTION

1. Field of the Invention

The present invention relates to an image forming apparatus, method of controlling an image forming apparatus, and a storage medium.

2. Description of the Related Art

In recent years, an advance has been achieved in image forming technology used in an image formation apparatus configured to form an image on a sheet. As a result, an increase in image formation speed has been achieved. In such a high-speed image forming apparatus, a large number of sheets are discharged at a high speed from a main body of the image forming apparatus. Thus, in the technology of a sheet stacking apparatus that is connected to a main body of an image forming apparatus and that is configured to stack sheets discharged from the main body of the image forming apparatus, there is a need for a large capacity of stacking a large number of sheets.

Some recent sheet stacking apparatuses have a plurality of sheet stacking units disposed in one sheet stacking apparatus. Some such sheet processing apparatuses are configured such that when small-size sheets such as A4-size sheets are handled, it is allowed to stack sheets on each sheet stacking unit thereby achieving a high capacity without increasing the apparatus size (for example, see Japanese Patent Laid-Open No. 2008-87965).

In such a sheet stacking apparatus, when sheets of a large size such as A3 size are stacked, sheets are stacked on a plurality of sheet stacking units in such a manner that sheets are placed over the plurality of sheet stacking units thereby making it possible to stack large-size sheets.

In a case where a plurality of sheet stacking units are disposed in a single sheet stacking apparatus, the sheet stacking units are configured to be capable of moving up and down independently. To take out sheets stacked on one sheet stacking unit, the sheet stacking unit is lowered down to a taking-out position, while another sheet stacking unit is raised. This allows it to take out the first sheet stacking unit from the sheet stacking apparatus while sheets are stacked on the second sheet stacking unit. For example, as shown in FIG. 16, a user removes the stack of sheets together with the stacker tray 112*a* and the dolly 120 from the sheet stacking apparatus. Note that, in this state, the other stacker tray, i.e., the stacker tray 112*b* remains in the sheet stacking apparatus. Therefore, it is possible to continue stacking a large number of sheets on the sheet stacking apparatus without stopping the operation of discharging sheets to the sheet stacking apparatus. This allows an increase in a stacking efficiency.

However, when the sheet stacking unit taken out from the sheet stacking apparatus is returned into the sheet stacking apparatus, there is a possibility that the sheet stacking unit is put by mistake at a wrong location different from a correct location to which the sheet stacking unit should be returned. The result of this is that there is no sheet stacking apparatus at one location but a plurality of sheet stacking apparatuses are set in a vertically overlapping manner at the other location. In this case, only one sheet stacking unit is usable, and the capacity of the sheet stacking apparatus is not fully used. This results in a reduction in the stacking efficiency.

SUMMARY OF THE INVENTION

According to an aspect of the present invention, there is provided an image forming apparatus comprising a sheet stacking control unit configured to perform a control operation so as to stack sheets, subjected to printing in a print job, on one of a plurality of removable sheet stacking units, a specifying unit configured to specify a sheet discharging unit used in the print job, a determining unit configured to determine whether a sheet stacking unit corresponding to the sheet discharging unit specified by the specifying unit is properly set, and a control unit configured to, in a case where the determining unit determines that the sheet stacking unit is not properly set, restrict conveying sheets to the sheet stacking unit specified by the specifying unit.

Further features of the present invention will become apparent from the following description of exemplary embodiments with reference to the attached drawings.

DESCRIPTION OF THE EMBODIMENTS

Embodiments of the present invention are described below with reference to the accompanying drawings.

Figure 1:
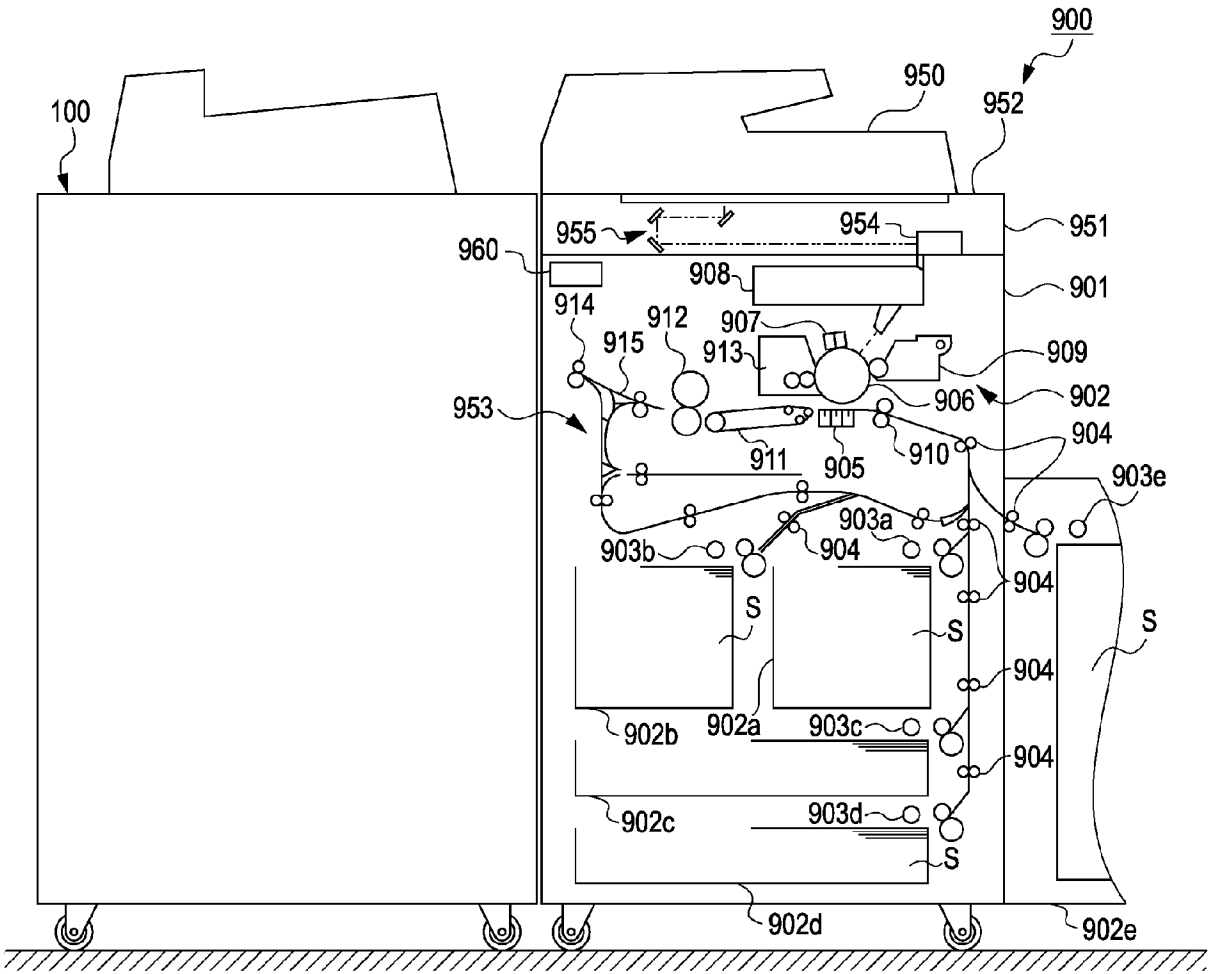
FIG. 1 is a diagram illustrating a construction of an image forming apparatus including a sheet stacking apparatus according to an embodiment of the present invention.

FIG. 1 is a cross-sectional view illustrating a construction of an image forming apparatus according to an embodiment of the present invention.

In FIG. 1, reference numeral 900 denotes an image forming apparatus, and reference numeral 901 denotes a main body of the image forming apparatus 900. On the top of the main body 901 of the image forming apparatus 900, there is provided an image reading apparatus 951 including a scanner unit 955 and an image sensor 954. On the top of the image reading apparatus 951, there is provided a document feeding apparatus 950 configured to feed documents to platen glass 952.

In a central part of the main part 901 of the image forming apparatus, there are provided an image forming unit 902 configured to form an image on a sheet and a duplex reversing apparatus 953. The image forming unit 902 includes a cylindrical photosensitive drum 906, a charger 907, a developing unit 909, a cleaning unit 913, etc. At a location downstream of the image forming unit 902, there are provided a fixing unit 912, discharge roller pair 914, etc.

The main body 901 of the image forming apparatus is connected to a stacker 100 serving as a sheet stacking apparatus configured to stack sheets that are discharged from the main part 901 of the image forming apparatus after the sheets are subjected to an image forming process. In FIG. 1, reference numeral 960 denotes a controller responsible for controlling the main body 901 of the image forming apparatus and the stacker 100.

Next, an explanation is given as to an image forming operation of the main body 901 of the image forming apparatus constructed in the above-described manner.

If an image forming signal is output from the controller 960, the document feeding apparatus 950 feeds a document onto the platen glass 952, and a document image is read by the image reading apparatus 951. Digital data obtained as a result of the reading is input to an exposure unit 908. By the exposure unit 908, the photosensitive drum 906 is illuminated with light corresponding to the digital data.

The surface of the photosensitive drum 906 has been uniformly charged by the charger 907 before it is illuminated with light, and the illumination of light causes an electrostatic latent image to be formed on the surface of the photosensitive drum 906. The electrostatic latent image is developed by the developing unit 909, and, as a result, a toner image is formed on the surface of the photosensitive drum 906.

Meanwhile, if a sheet feed signal is output from the controller 960, one of sheets set on either one of cassettes 902*a* to 902*d* or one of sheets set a sheet feed deck 902*e* is conveyed to a registration roller 910 by paper feed rollers 903*a* to 903*e* and a conveying roller pair 904.

The sheet is then conveyed by the registration roller 910 to a transfer unit having a transfer/detach charger 905 such that the leading end of the sheet comes exactly to the leading edge of the toner image formed on the photosensitive drum 906. In the transfer unit, a transfer bias voltage is applied to the sheet by the transfer/detach charger 905 thereby transferring the toner image on the photosensitive drum 906 to the sheet.

After the toner image has been transferred to the sheet, the sheet is conveyed by a conveying belt 911 to the fixing unit 912. In the fixing unit 912, the sheet is passed between a heating roller and a pressure roller of the fixing unit 912 thereby heating and fixing the toner image. In this process, excess toner remaining on the photosensitive drum 906 without being transferred to the sheet and other foreign materials on the photosensitive drum 906 are scraped off by a blade of the cleaning unit 913 such that the surface of the photosensitive drum 906 is cleaned to prepare for a next image forming process.

The sheet with the fixed image is either directly conveyed to the stacker 100 by the discharge roller pair 914 or directed to the duplex reversing apparatus 953 by the flapper 915 to again perform an image forming process.

Figure 2:
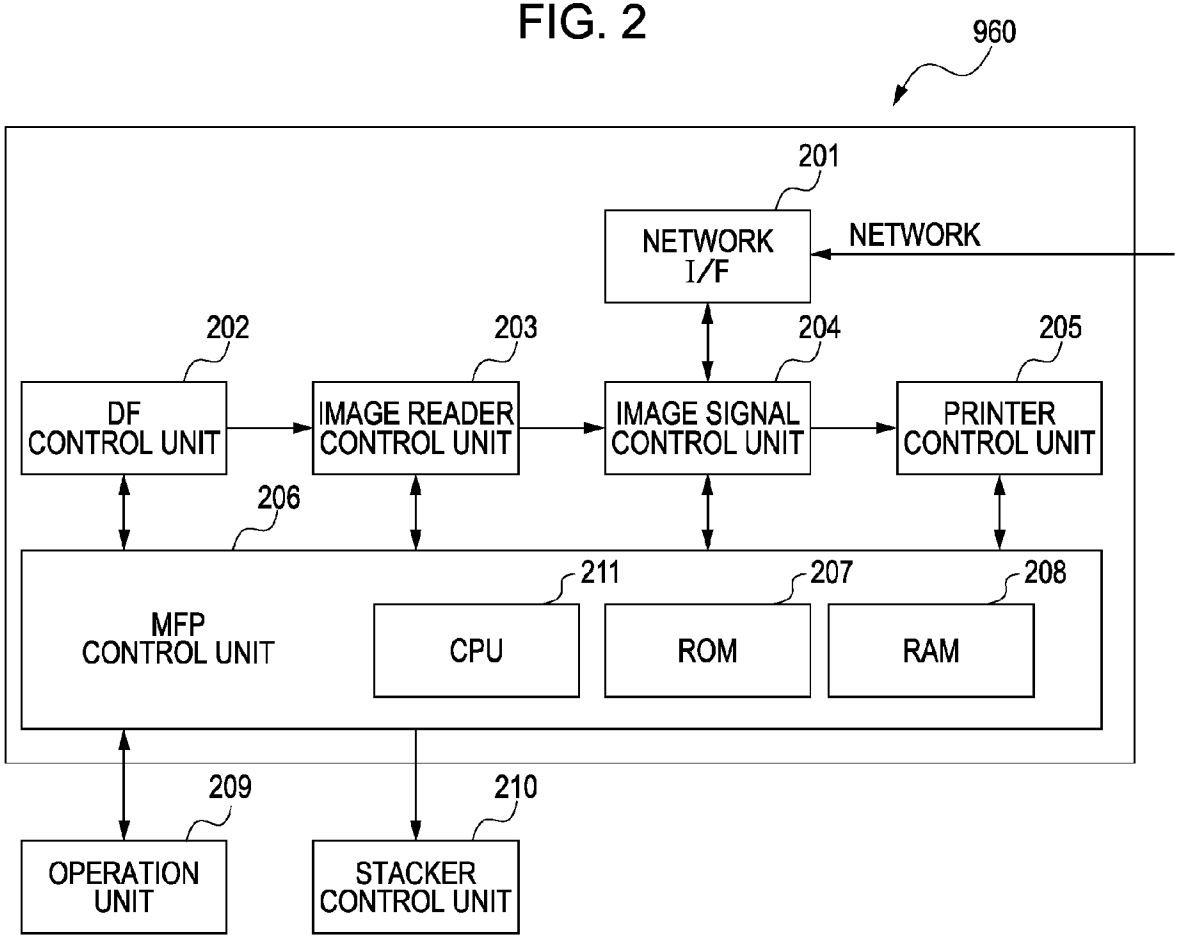
FIG. 2 is a control block diagram of a controller disposed in an image forming apparatus according to an embodiment of the present invention.

FIG. 2 is a block diagram illustrating a configuration of the controller 960 according to the present embodiment of the invention. The controller 960 includes an MFP control unit 206 including a CPU 211, a ROM 207, and a RAM 208. In accordance with a control program stored in the ROM 207, the controller 960 generally controls a DF (document feed) control unit 202, an operation unit 209, an image reader control unit 203, an image signal control unit 204, a printer control unit 205, and a stacker control unit 210. Furthermore, in accordance with the control program stored in the ROM 207, the controller 960 manages jobs in the image forming apparatus 900 and controls generation and deletion of jobs, status of jobs, processing order of jobs, etc. The RAM 208 is used to temporarily store control data and also is used as a work area in control operations.

The DF control unit 202 drives and controls the document feeding apparatus 950 under the control of the CPU 211. The image reader control unit 203 drives and controls the scanner unit 955, the image sensor 954, and other units disposed in the image reading apparatus 951 and transfers an analog image signal output from the image sensor 954 to the image signal control unit 204.

The image signal control unit 204 converts the analog image signal output from the image sensor 954 into a digital signal. The digital signal is subjected to various processes and is converted into a video signal. The image signal control unit 204 outputs the resultant video signal to the printer control unit 205.

When the image signal control unit 204 receives a digital image signal input from a network via a network interface 201, the image signal control unit 204 performs various processes on the digital image signal, and converts the digital image signal into a video signal. The image signal control unit 204 outputs the resultant video signal to the printer control unit 205. Note that the processing operation of the image signal control unit 204 is controlled by the CPU 211.

The printer control unit 205 drives the exposure unit 908 via an exposure control unit (not shown) in accordance with the input video signal.

The operation unit 209 includes a plurality of keys used to set various functions associated with image formation, and a display unit configured to display various kinds of information associated with settings, status of jobs, etc. If a key is operated by a user, a key signal corresponding to the operated key is output to the MFP control unit 206. Conversely, when the operation unit 209 receives a signal from the MFP control unit 206, information is displayed on the display unit according to the received signal. In the present embodiment, a liquid crystal display is employed as the display unit on the operation unit 209. A touch panel is disposed on a front surface of the liquid crystal display.

Figure 3:
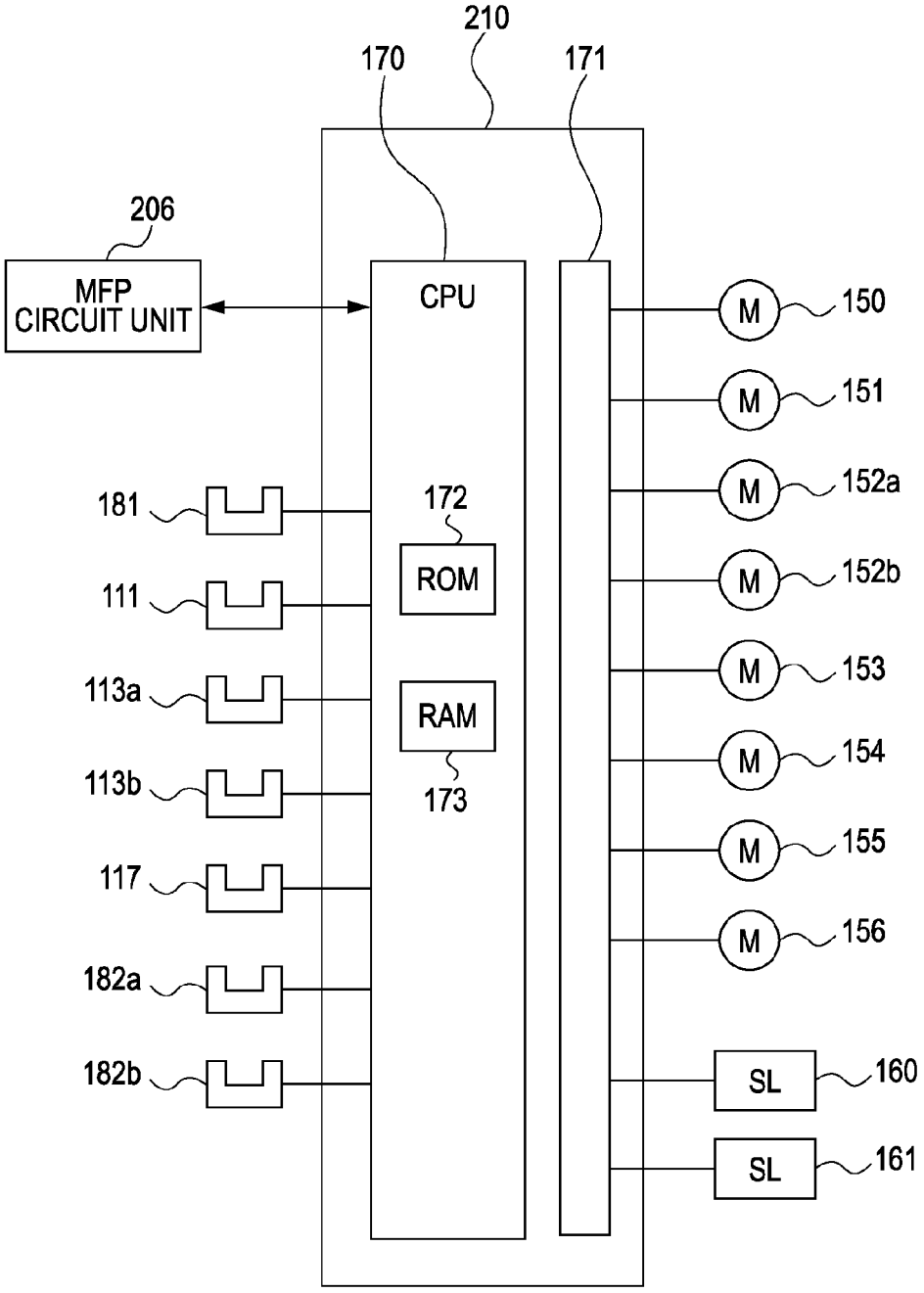
FIG. 3 is a control block diagram of a stacker control unit disposed in a stacker serving as a sheet stacking apparatus according to an embodiment of the present invention.

The stacker control unit 210 is disposed in the stacker 100 and generally controls the operation of the stacker 100 by sending/receiving information to/from the MFP control unit 206. The stacker control unit 210 includes, as shown in FIG. 3, a CPU 170 that sends/receives information to/from the MFP control unit 206, and also includes a ROM 172, a RAM 173, a driver unit 171, etc. The driver unit 171 is connected to various motors (150 to 156), various solenoids (160 and 161), and various sensors such as a sheet surface detection sensor 117.

Figure 4:
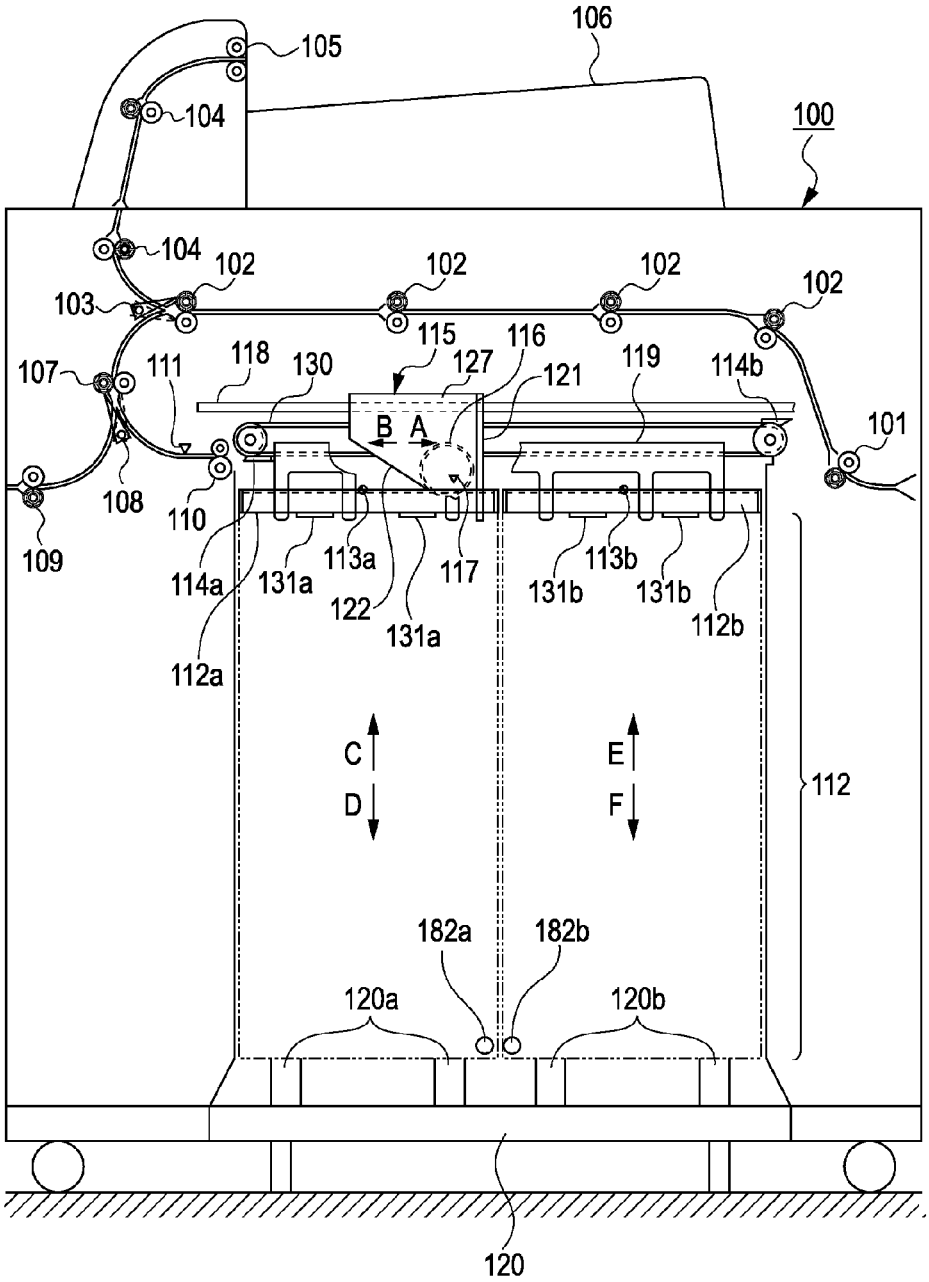
FIG. 4 is a diagram illustrating a construction of a stacker according to an embodiment of the present invention.

FIG. 4 is a cross-sectional view illustrating the construction of the stacker 100 serving as a sheet stacking apparatus according to the present embodiment of the invention. The stacker 100 includes a top tray 106 disposed on the top of the stacker 100. The top tray 106 is for stacking sheets discharged from the main body 901 of the image forming apparatus 901. The stacker 100 also includes a stack unit 112 for stacking sheets. The stack unit 112 includes a plurality of sheet stacking units (first and second stacker trays 112*a* and 112*b*) arranged in the sheet discharging direction as described below.

In the stack unit 112 according to the present embodiment, the stacker tray 112*a* serving as a first sheet stacking unit is disposed at an upstream part in the sheet discharging direction (in the sheet conveying direction), and the second stacker tray 112*b* is disposed at a downstream part in the sheet discharging direction (sheet conveying direction) from the first stacker tray 112*a*.

Figure 10:
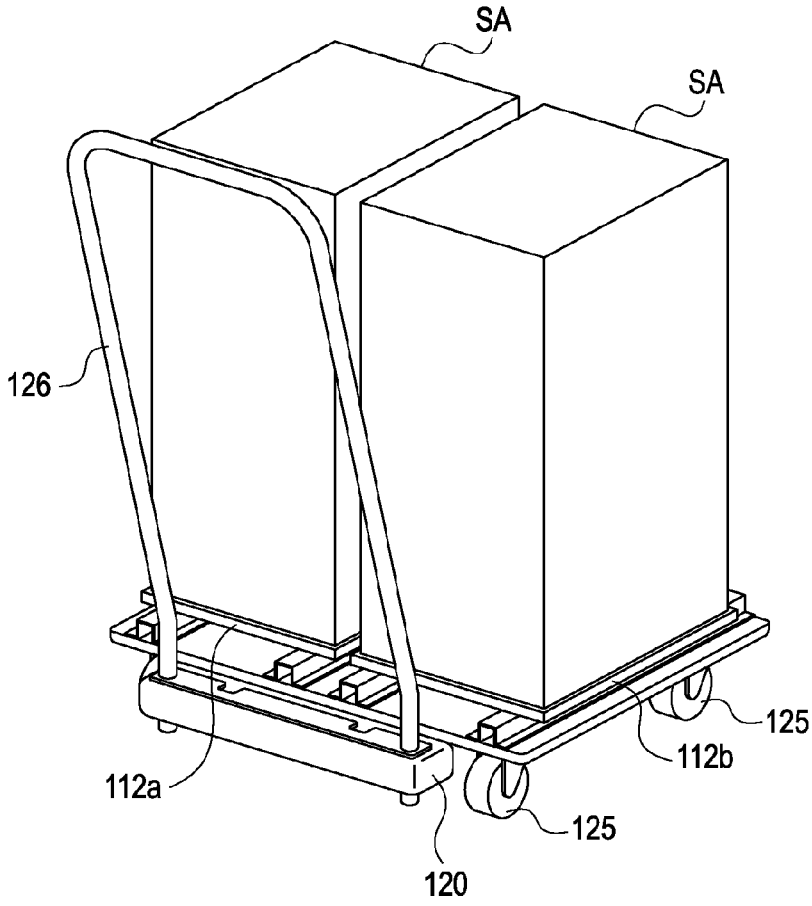
FIG. 10 is a perspective view illustrating a manner in which stacks of sheets are put on a dolly according to an embodiment of the present invention.

As shown in FIG. 4, the first and second stacker trays 112*a* and 112*b* are disposed such that they can independently move up and down in directions denoted by arrows C, D, E, and F by first and second stacker tray up-and-down motors 152*a* and 152*b* (see FIG. 3). The first and second stacker trays 112*a* and 112*b* are configured to be removable. As shown in FIG. 10, the first and second stacker trays 112*a* and 112*b* can be detached together with the dolly 120 from the stacker 100 to carry the sheets stacked thereon. The stacker 100 has a front door (not shown) which is to be opened when the dolly 120 is taken out. As shown in FIG. 10, the dolly has a handle, which may be removable from the dolly 120.

The stacker 100 further includes a top tray switching flapper 103, which is driven by a flapper solenoid 160 (see FIG. 3) such that a sheet conveyed into the stacker is directed to the top tray 106 or the stack unit 112 serving as another sheet stacking unit.

Reference numeral 108 denotes a stacker exit switching flapper. This stacker exit switching flapper 108 is driven by an exit switching solenoid 161 (see FIG. 3) when a sheet processing apparatus such as a sheet post-processing apparatus such as another stacker apparatus, bookbinding apparatus, or sheet trimming apparatus (not shown) disposed at a downstream location is specified as an apparatus to which sheets are to be discharged.

In FIG. 4, reference numeral 115 denotes a sheet guide unit configured to guide the sheet discharged by a sheet discharge roller pair 110 toward the stacker tray. The sheet guide unit 115 includes a knurl belt 116 that rotates in a counterclockwise direction and that has elasticity to draw in the sheet to above the stacker tray, and a leading end stopper 121 serving as a stopper for positioning of the sheet in a sheet discharge direction. Note that the knurl belt 116 is driven by a knurl belt motor 154 (see FIG. 3).

The sheet guide unit 115 operates such that the conveyed sheet is drawn by the knurl belt 116 into between the knurl belt 116 and the stacker tray 112*a* (or the stacker tray 112*b*) and is brought into contact with the leading end stopper 121. Thus, discharged sheets are stacked on the stacker tray 112*a* or 112*b* in such a manner that the sheets are properly positioned.

The sheet guide unit 115 is disposed in such a manner that it is movable along a slide shaft 118 in directions denoted by arrows A and B, and the sheet guide unit 115 is driven by a guide motor 153 (see FIG. 3) to move to a position corresponding to a sheet size. The sheet guide unit 115 includes a frame 127 having a tapered surface 122 formed so as to guide a drawn-in sheet to the knurl belt 116.

Reference numeral 117 denotes a sheet surface detection sensor that is used to keep the distance constant between the sheet guide unit 115 and an upper surface of the sheet.

There is disposed a first stacker tray setting sensor 182*a* configured to detect whether the first stacker tray 112*a* is set at a lowest allowable location of the first stacker tray 112*a*.

Similarly, there is disposed a second stacker tray setting sensor 182*b* configured to detect whether the second stacker tray 112*b* is set at a lowest allowable location of the second stacker tray 112*b*.

Each of stacker tray setting sensors 182*a* and 182*b* detects setting of a corresponding stacker tray when the stacker trays 112*a* and/or 112*b* mounted on the dolly 120 come into contact with the stacker tray setting sensors 182*a* and 182*b*.

Reference numerals 113*a* and 113*b* denote home position sensors configured to detect home positions of the respective first and second stacker trays 112*a* and 112*b* in an initial operation. In the sheet stacking operation, the home position sensors 113*a* and 113*b* function as sensors for detecting the surface of a sheet on the top of the stack of sheets put on the first and second stacker trays 112*a* and 112*b*. In the present embodiment, when there are no sheets on the first and second stacker trays 112*a* and 112*b*, the home position sensors 113*a* and 113*b* function as sensors to detect whether the first and second stacker trays 112*a* and 112*b* are set in the stacker 100.

Use of the stacker tray setting sensors and the home position sensors allows it to detect whether the stacker trays are set by mistake on the same side in the stack unit.

When sheets are discharged, as shown in FIG. 4, the first and second stacker trays 112*a* and 112*b* are controlled by the home position sensors 113*a* and 113*b* to be located in the home positions in which sheets are allowed to be stacked When the first and second stacker trays 112*a* and 112*b* are both in their home position, the sheet stacking plane is at the same height for both the stacker trays 112*a* and 112*b*.

A lift 131*a* is disposed in the stacker 100 to move the first stacker tray 112*a* up and down. A lift 131*b* is disposed in the stacker 100 to move the second stacker tray 112*b* up and down. The lift 131*a* is driven up and down by a first stacker tray up-and-down driving motor 152*a* (see FIG. 3), while the lift 131*b* is driven up and down by a second stacker tray up-and-down driving motor 152*b* (see FIG. 3).

Figure 16:
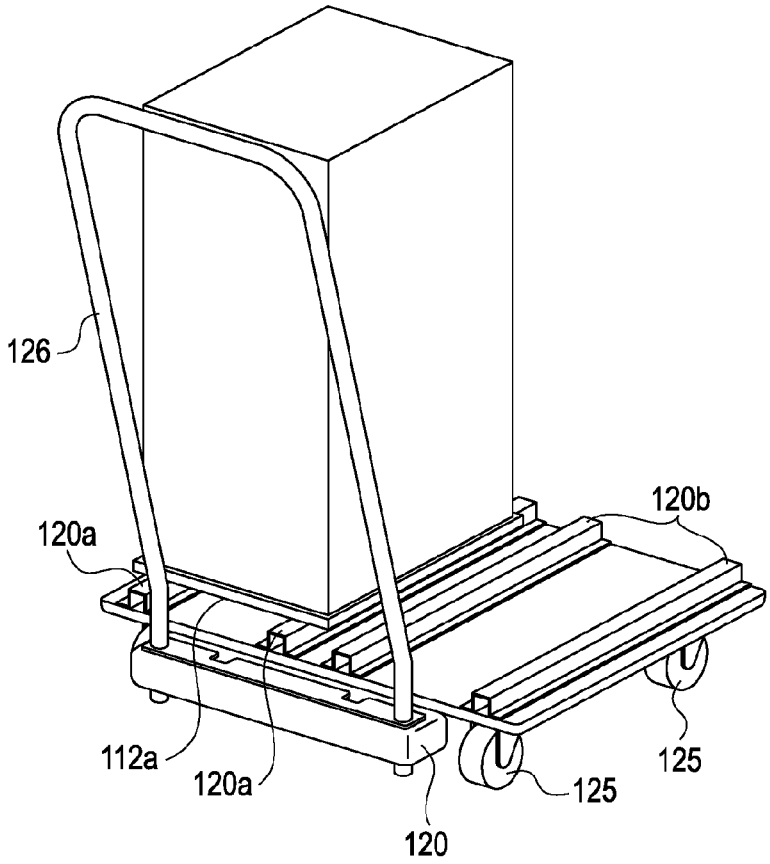
FIG. 16 PRIOR ART
FIG. 16 is a perspective view illustrating a manner in which a stack of sheets is put on a dolly according to a conventional technique.

To set the dolly 120 in the stacker 100, a user opens the front door of the stacker 100 and sets the dolly 120 with the first stacker tray 112*a* and the second stacker tray 112*b* mounted thereon into the stacker 100. As a result, the lift 131*a* is inserted between two stacker tray supporters 120*a* (see FIG. 16) and below the first stacker tray 112*a*, while the lift 131*b* is inserted between two stacker tray supporters 120*b* and below the second stacker tray 112*b*. If the front door of the stacker 100 is then closed, the lift 131*a* and the lift 131*b* move up while supporting the first stacker tray 112*a* and the second stacker tray 112*b*. In a case where there is no sheet on the stacker trays, the stacker trays are raised to their home position. Thereafter, sheets are stacked on the stacker trays. Note that the lifts 131*a* and 131*b* each include two pieces of lifts, and they are made of a strong material such that they are not bent or broken when sheets are stacked on the first stacker tray 112*a* and the second stacker tray 112*b*.

A driving belt 130 has a grippers 114*a* and 114*b* disposed thereon and is configured to be rotatable in a counterclockwise direction when driven by a driving belt motor 155 (see FIG. 3).

The grippers 114*a* and 114*b* form, together with the driving belt 130, a sheet conveying unit to convey a sheet. In the conveying operation, a sheet is gripped at its one end on an upstream side as seen in the sheet discharging direction.

Figure 5:
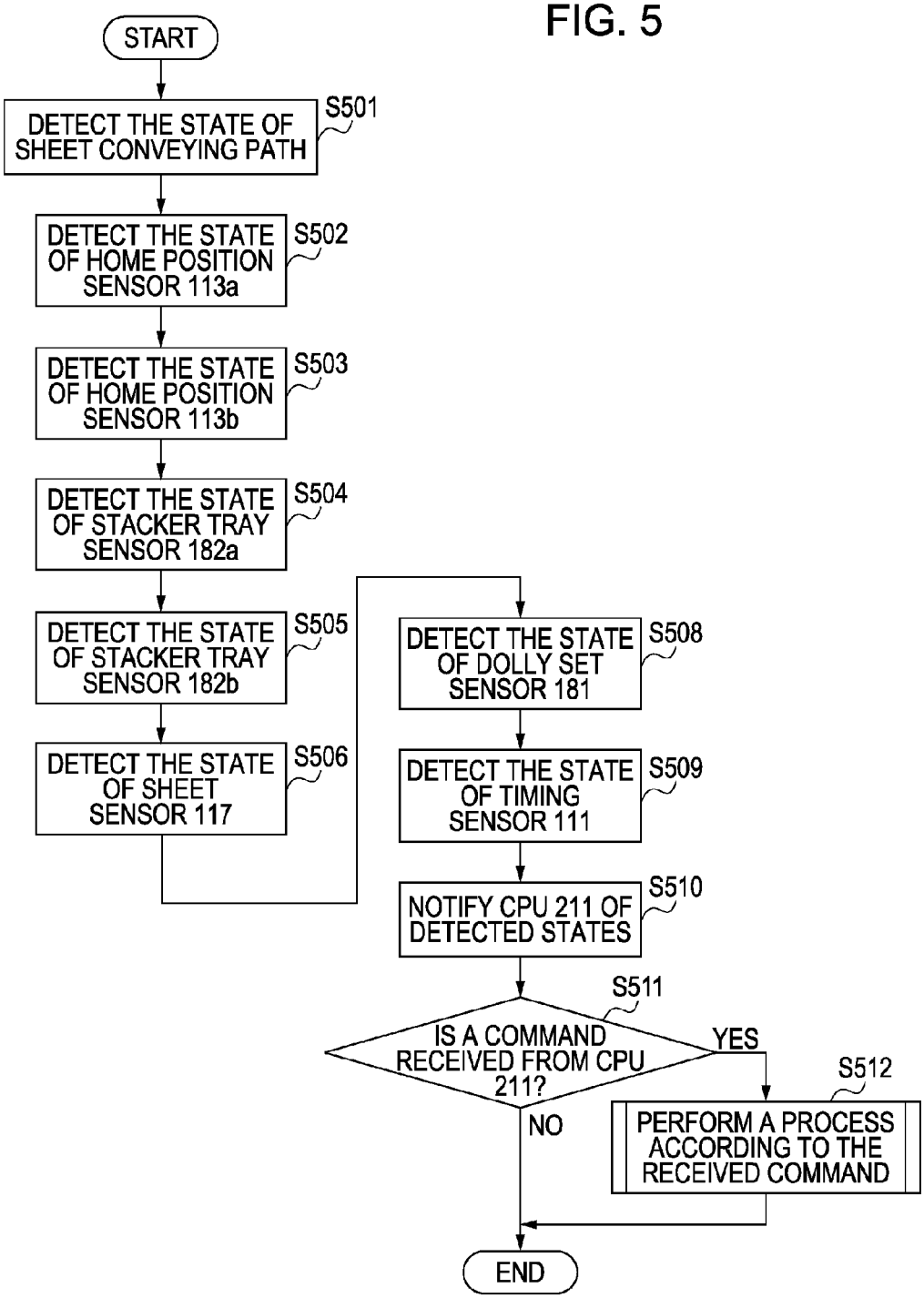
FIG. 5 is a flow chart illustrating a process of detecting a status of a stacker according to an embodiment of the present invention.

Next, with reference to a flow chart shown in FIG. 5, an explanation is given below as to a process of detecting the status of the stacker 100 configured in the above-described manner. The process shown in the flow chart of FIG. 5 is executed by the CPU 170 of the stacker control unit 210 according to a program stored in a ROM shown in FIG. 3.

First, the CPU 170 checks sensors (not shown) to determine whether there is a sheet remaining in a sheet conveying path in the stacker 100, whether a jam has occurred, and other statuses (S501).

In following steps S502 to S509, statuses are detected as to the home position sensors 113*a* and 113*b*, the stacker tray setting sensors 182*a* and 182*b*, the sheet surface detection sensor 117, the dolly setting sensor 118, and the timing sensor 111. The CPU 170 notifies the CPU 211 of the detected status of each sensor (S510).

The CPU 210 checks whether a command is received from the CPU 211 (S511). If it is determined that a command has been received, the CPU 210 executes a process according to the received command (S512). If it is determined that no command is received, the process is ended.

The process shown in FIG. 5 is performed repeatedly by the CPU 211 at a predetermined intervals to detect in real time the status of the stacker 100.

Figures 6, 6A:
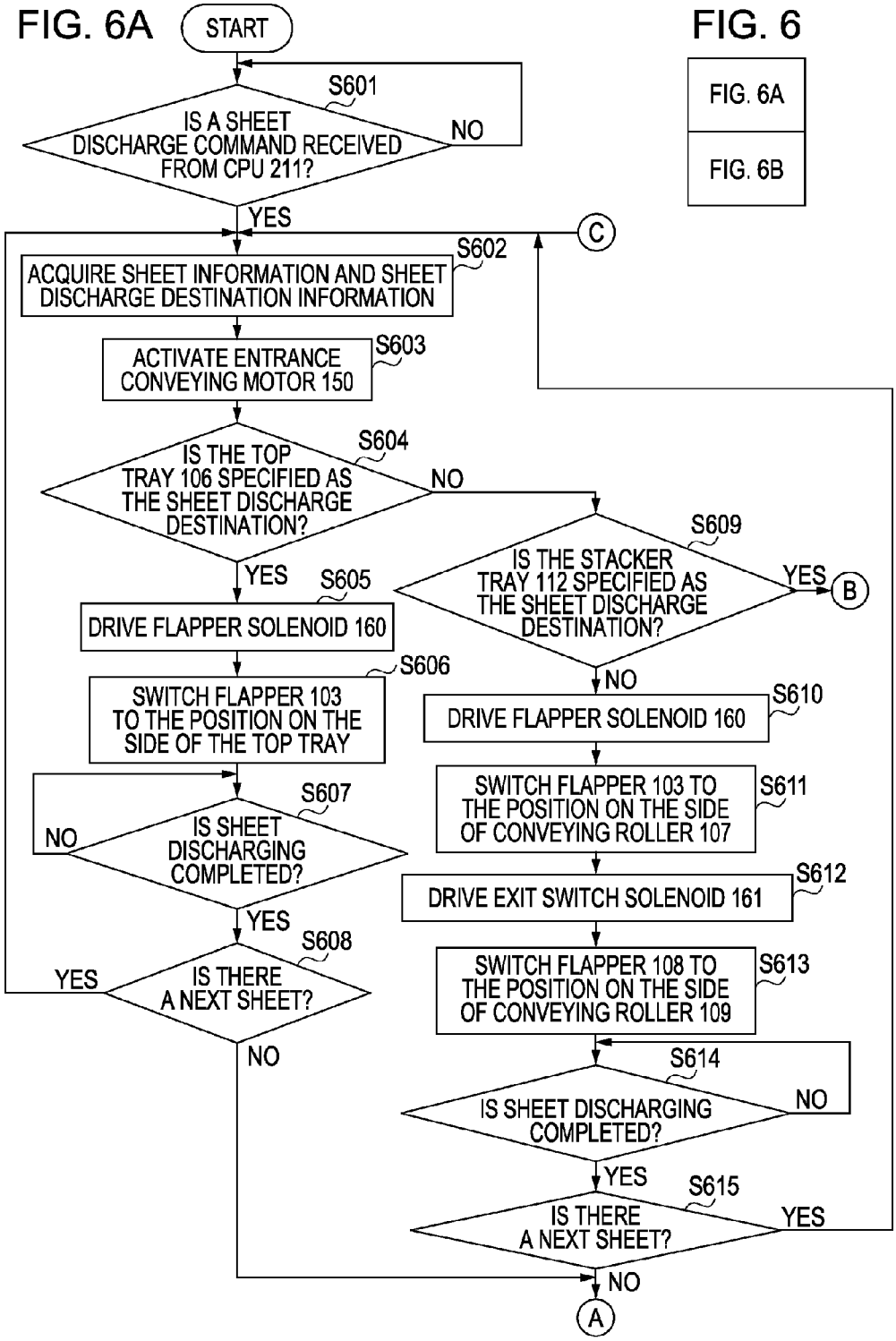
FIG. 6 is a flow chart illustrating a sheet conveying operation of a stacker according to an embodiment of the present invention.
Figure 6B:
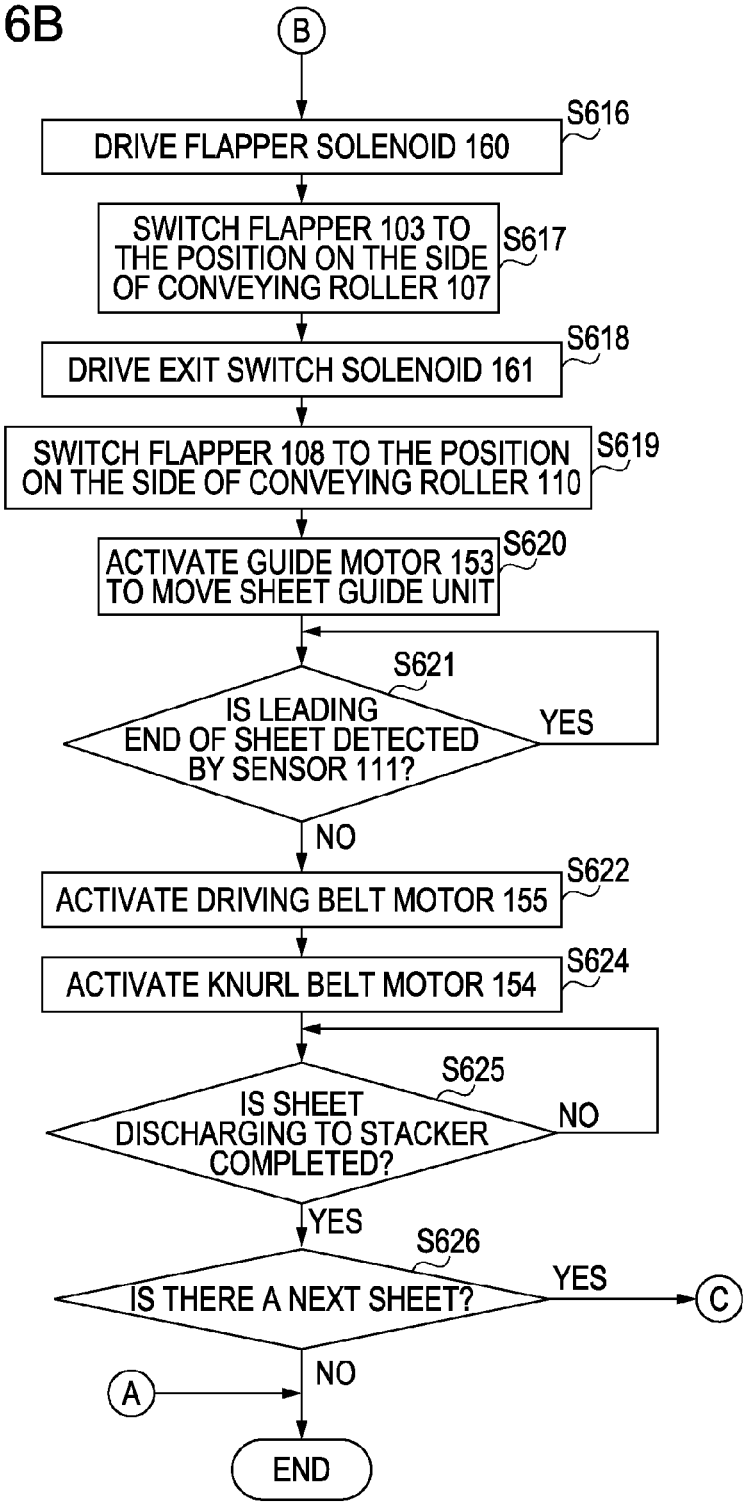

Next, with reference to a flow chart shown in FIG. 6, an explanation is given below as to a sheet conveying operation of the stacker 100. The process shown in the flow chart of FIG. 6 is executed by the CPU 170 of the stacker control unit 210 according to the program stored in the ROM shown in FIG. 3.

When a sheet is discharged from the main body 901 of the image forming apparatus, the CPU 170 receives a sheet discharge command from the CPU 211 (S601).

On receiving the sheet discharge command, CPU 170 analyzes the received command to detect information associated with the sheet, such as a sheet size, a sheet type, and a sheet discharge destination (S602).

Subsequently, the CPU 170 drives an entrance conveying motor 150 (S603). The sheet discharged from the main body 901 of the image forming apparatus is first conveyed into the inside of the stacker 100 via an entrance roller pair 101 shown in FIG. 4.

Subsequently, the CPU 170 of the stacker control unit 210 determines whether the top tray 106 is specified as a sheet discharge destination (S604). In a case where it is determined that the top tray 106 is specified as the sheet discharge destination, the flapper solenoid 160 (see FIG. 3) is driven (S605) such that the flapper 103 is switched to a position that allows the sheet to be directed to the top tray 106 (S606). The sheet is conveyed to a conveying roller pair 104 and then discharged by a sheet discharge roller pair 105 to the top tray 106. The discharged sheet is stacked on the top tray 106 (S607). If there is a next sheet to be discharged (S608), the process returns to step S602 but otherwise the motors and the solenoids are deactivated and the process is ended.

On the other hand, in a case where it is determined in step S604 that the top tray 106 is not specified as the sheet discharge destination, the process proceeds to step S609.

In step S609, a determination is made as to whether the stacker unit 112 (the stacker tray 112*a* or 112*b*) is specified as the sheet discharge destination. In a case where the CPU 170 determines that neither the stacker tray 112*a* nor the stacker tray 112*b* is specified as the sheet discharge destination, i.e., for example, in a case where a sheet post-processing apparatus (not shown) disposed at a downstream location is specified as the apparatus to which the sheets are to be discharged, the CPU 170 advances the process to step S610. In step S610, the above-described flapper solenoid 160 is driven to switch the flapper 103 to the side of the conveying roller 107 (S611). Furthermore, an exit switching solenoid 161 is driven (S612) such that an exit switching flapper 108 is switched to the position that allows the sheet to be directed to the sheet post-processing apparatus (not shown) disposed at a downstream location (S613). The CPU 170 performs a control operation such that the sheet is conveyed by a conveying roller pair 102 and further conveyed by a conveying roller pair 107 to be directed to an exit roller pair 109, and is finally conveyed to the sheet post-processing apparatus (not shown) disposed at the downstream location (S614). Subsequently, a determination is made as to whether there is a next sheet to be discharged (S615). If there is a next sheet to be discharged, the process returns to step S602 but otherwise the motors and the solenoids are deactivated and the process is ended. Note that the conveying operation described above is performed by a conveying motor 151.

On the other hand, in a case where it is determined that the stacker tray 112*a* or 112*b* is specified as the sheet discharge destination, the top tray switching flapper 103 and the exit switching flapper 108 are switched to positions that allow sheets to be directed to the stacker tray 112*a* or 112*b* (steps S616 to S619) such that the sheet is guided by the top tray switching flapper 103 and exit switching flapper 108 and conveyed to the sheet discharge roller pair 110.

To stack the sheet on the stacker tray specified by the CPU 211, the guide motor 153 is activated to move the sheet guide unit 115 to a proper position (S620).

Before the sheet reaches the sheet discharge roller pair 110, a passing timing of the leading end of the sheet is detected by the timing sensor 111 disposed upstream of the sheet discharge roller pair 110 (S621). Thereafter, the sheet is conveyed by the sheet discharge roller pair 110 toward one gripper 114*a* being at rest in the waiting state. When the leading end of the sheet reaches the gripper 114*a*, the leading end of the sheet is gripped by the gripper 114*a*.

In synchronization with the gripping, the driving belt motor 155 is activated (S622) to drive the driving belt 130 in the counterclockwise direction so that the gripper 114*a* gripping the leading end of the sheet moves together with the driving belt 130. Thus, the sheet is conveyed over and across the first stacker tray 112*a*.

In a case where the sheet is of a small size such as an A4-size sheet, when the gripper 114*a* passes by a tapered part 122 formed on the sheet guide unit 115 on the side of the gripper, the sheet is brought into contact with the tapered part 122 and is separated from the gripper 114*a*. In this state, the sheet guide unit 115 is in the waiting position at a location downstream of the first stacker tray 112*a* as seen in the sheet discharging direction. Note that the two grippers 114*a* and 114*b* are moved by the driving belt along a circulation path such that the two grippers 114*a* and 114*b* alternately convey sheets to the first stacker tray 112*a* whereby sheets are stacked one by one on the first stacker tray 112*a*.

Thereafter, the sheet is conveyed in such a manner that the leading end of the sheet is guided by the tapered part 122 toward the first stacker tray 112*a* such that the sheet is directed to the knurl belt 116. In this process, the sheet gains inertia when the sheet is conveyed, and this inertia causes the sheet to move until the sheet comes in contact with the knurl belt 116.

After that, the CPU 170 activates the knurl belt motor 154 (S624). If the knurl belt motor 154 is activated, the sheet is conveyed by the knurl belt 116 such that the sheet intrudes into between the knurl belt 116 and the first stacker tray 112*a*

(or into between the knurl belt 116 and a sheet on the top of the stack of the sheets when there are sheets on the first stacker tray 112*a*).

The sheet is then conveyed until the leading end of the sheet comes into contact with the stopper 121. As a result, the leading end of the sheet is correctly aligned. The sheet is then discharged to the first stacker tray 112*a* or onto the top of the stack of sheets already put on the first stacker tray 112*a* (S625).

After the sheet has been discharged onto the stacker tray 112*a*, a determination is made as to whether there is a next sheet (S626). If there is a next sheet, the process returns to step S602 but otherwise the motors and the solenoids are deactivated and the process is ended.

Figure 7:
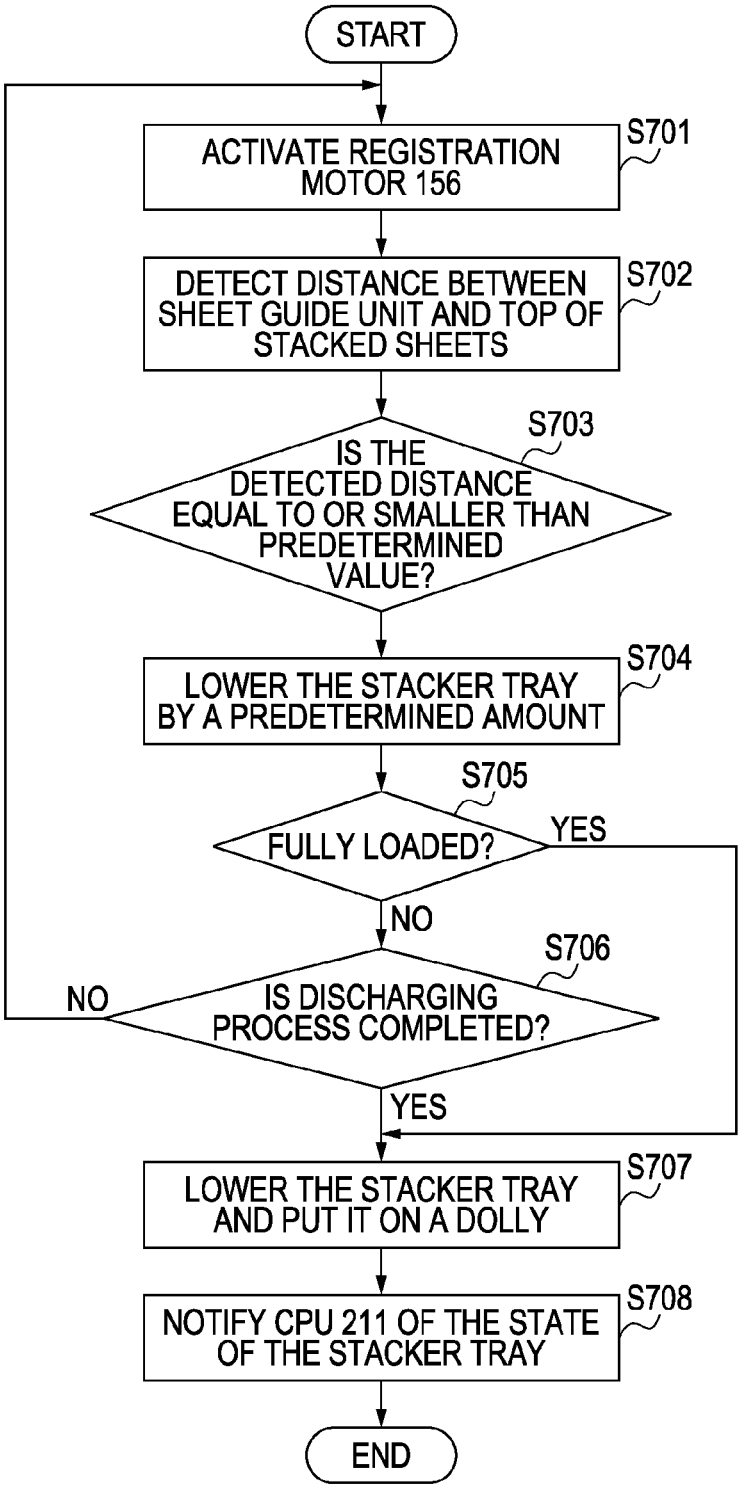
FIG. 7 is a flow chart illustrating a sheet stacking operation of a stacker according to an embodiment of the present invention.
Figure 8:
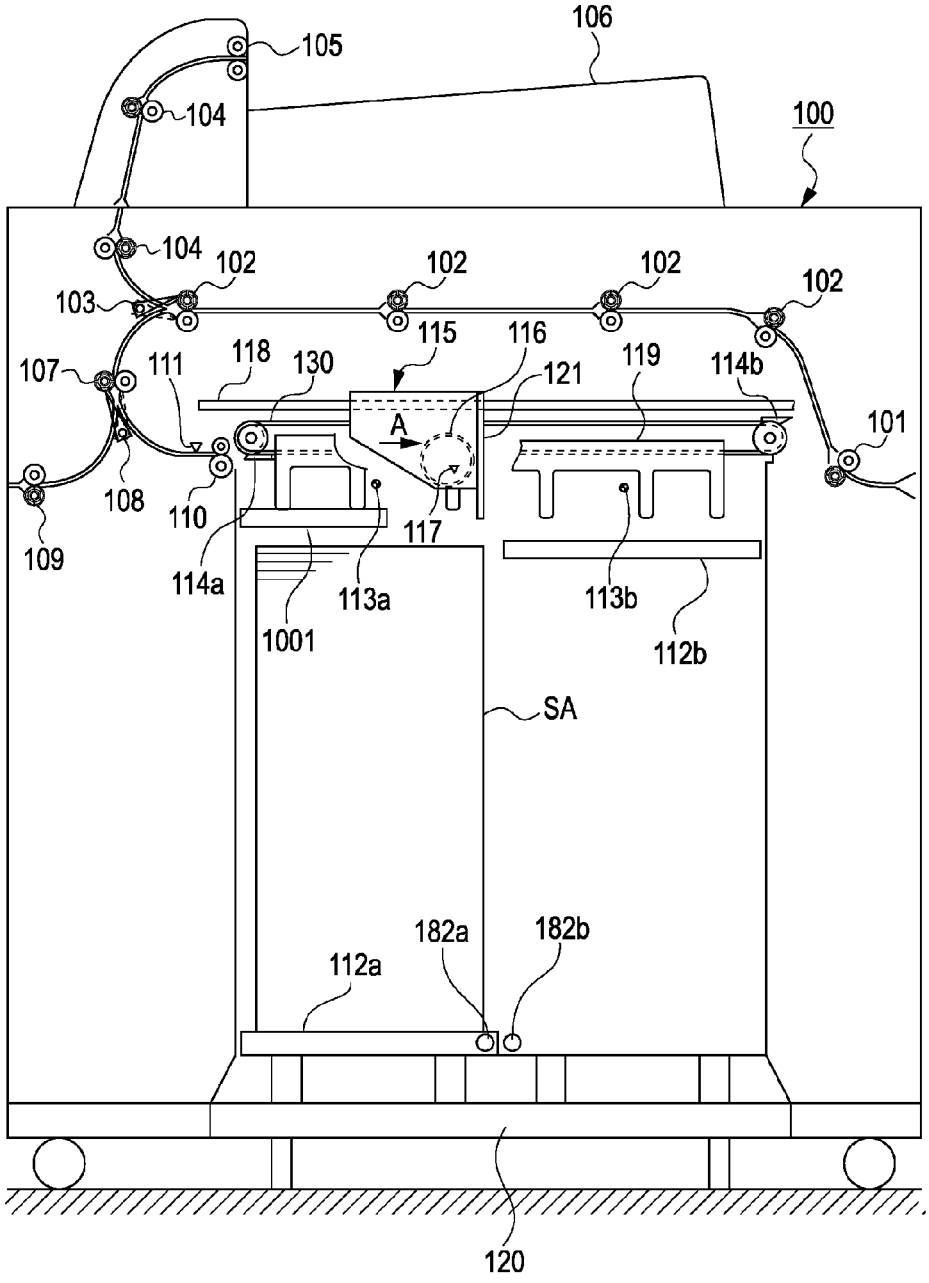
FIG. 8 is a diagram illustrating a stacker in a state in which a first stacker tray with sheets fully stacked thereon is lowered down and put on a dolly according to an embodiment of the present invention.
Figure 9:
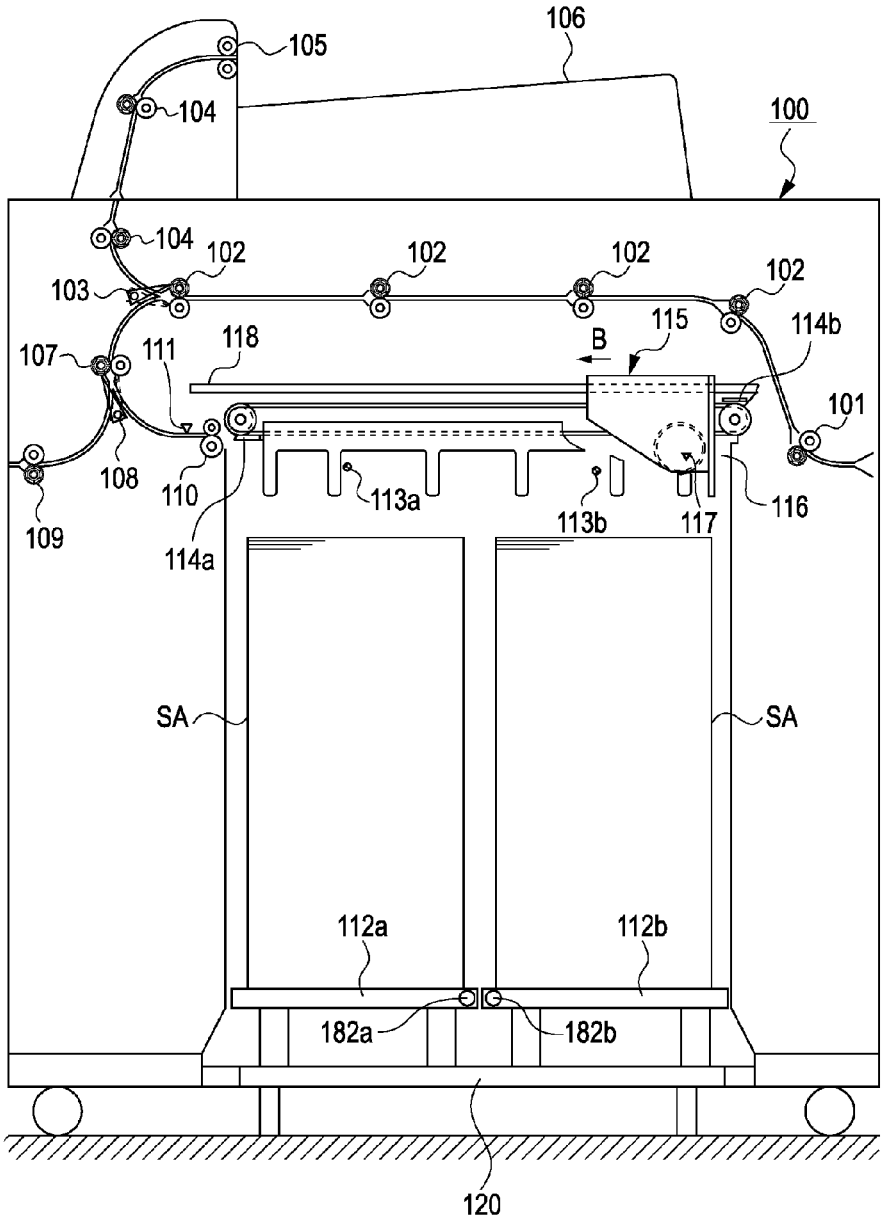
FIG. 9 is a diagram illustrating a stacker in a state in which a second stacker tray with sheets fully stacked thereon is lowered down and put on a dolly according to an embodiment of the present invention.

Next, with reference to FIG. 7, a sheet stacking operation of the stacker tray 112*a* or 112*b* is explained below. The process shown in the flow chart of FIG. 7 is executed by the CPU 170 of the stacker control unit 210 according to the program stored in the ROM shown in FIG. 3.

After the sheet has been discharged onto the stacker tray 112*a* or 112*b* in the above-described manner, the CPU 170 starts a sheet stacking processing task.

If the sheet stacking processing task is started, an aligning plate 119 is driven by an aligning motor 156 (see FIG. 3) (S701) so that the aligning plate 119 is moved in a direction perpendicular to the sheet conveying direction, i.e., in a direction toward the front side of the main body of the image forming apparatus thereby aligning the stacked sheets SA in a width direction. After the stacked sheets SA are aligned, the aligning plate 119 is moved back in the width direction by a predetermined distance and waits for a next sheet to arrive.

The CPU 170 of the stacker control unit 210 always monitors, via the sheet surface detection sensor 117, the upper surface of a sheet on the top of the sheets that have been discharged and stacked, thereby detecting the distance between the sheet guide unit 115 and the sheet on the top of the stacked sheets (S702). If the distance between the sheet guide unit 115 (more specifically, the knurl belt 116 of the sheet guide unit 115) and the sheet on the top of the stacked sheets becomes smaller than a predetermined value (S703), the first stacker tray 112*a* is moved down by a predetermined proper amount by the first stacker tray up-and-down driving motor 152*a* (see FIG. 3) (S704) so that the distance between the sheet guide unit 115 (more specifically, the knurl belt 116 of the sheet guide unit 115) and the sheet on the top of the stacked sheets is increased to an adequate value that allows a next sheet to be stacked.

By performing the above-described operation repeatedly, sheets are stacked one by one on the first stacker tray 112*a*. Depending on the number of sheets specified by the job, the first stacker tray 112*a* is fully loaded with sheets stacked thereon. The detection as to whether the stacker tray is fully loaded with sheets is made by the stacker control unit 210 by counting the detection signal that is output by the timing sensor 111 each time a sheet is discharged by the sheet discharge roller pair 110. Alternatively, the detection as to whether the stacker tray 112*a* is fully loaded with sheets may be performed stacker control unit 210 by monitoring the distance by which the stacker tray 112*a* is lowered and the location of the sheet on the top.

If the fully stacked state of the first stacker tray 112*a* is detected in the above-described manner (S705) or if the process of stacking sheets is completed (S706), then the CPU 170 of the stacker control unit 210 performs a control operation as described below with reference to FIG. 10. The CPU 170 of the stacker control unit 210 lowers the first stacker tray 112*a* (S707) and puts the stack of sheets SA on the dolly 120.

Thereafter, the CPU 170 notifies the CPU 211 that the first stacker tray 112*a* is in the fully stacked state and the process of stacking sheets is completed. Thereafter, the process is ended (S708).

After the first stacker tray 112*a* is fully loaded with sheets stacked thereon, the dolly 120 serving as a taking-out unit disposed removably in the main body 100A of the stacker 100 is taken out of the stacker 100. This makes it possible to take out the full stack of sheets SA together with the first stacker tray 112*a*.

Thereafter, the stack of sheets is removed from the dolly 120, and the dolly 120 and the first stacker tray 112*a* are again set in the stacker 100. The stacker control unit 210 activates the first stacker tray up-and-down driving motor 152*a* to raise the first stacker tray 112*a*. As a result, the first stacker tray 112*a* returns into the state shown in FIG. 4 in which new sheets are allowed to be stacked on the first stacker tray 112*a*.

Depending on the print job, there is a possibility that the number of sheets to be stacked is greater than a maximum number of sheets allowed to be stacked on the first stacker tray 112*a*. Another possibility is that there are sheets previously stacked on the first stacker tray 112*a*, which can cause the first stacker tray 112*a* to be fully loaded with sheets stacked thereon before the print job is completed. In such a case, remaining sheets may be stacked on another stacker tray, i.e., the second stacker tray 112*b*.

In this case, the CPU 170 lowers the first stacker tray 112*a* fully loaded with stacked sheets so that the first stacker tray 112*a* does not prevent sheets from being conveyed to the second stacker tray 112*b*. As a result, the stacked sheets are put on the dolly 120 in the manner described above. The CPU 211 is notified of this fact. In response, the CPU 211 sends a command to the CPU 170 to switch the sheet discharge destination to the second stacker tray 112*b*. In response to the command, before the sheet is conveyed, the sheet guide unit 115 is moved in the direction indicated by the arrow A in FIG. 4 to a waiting position located downstream of the second stacker tray 112*b* as seen in the sheet discharging direction. Note that during this process, the second stacker tray 112*b* is waiting in its home position.

If the waiting position of the sheet guide unit 115 is set at the center of the second stacker tray 112*b*, a smooth and reliable operation can be achieved. This is also true when sheets are stacked on the first stacker tray 112*a*. However, to make it possible to stack a greater number of sheets, the waiting position of the sheet guide unit 115 may be set at other locations as long as sheets does not extend beyond the edge of the first or second stacker tray 112*a* or 112*b*.

The operation of discharging sheets onto the second stacker tray 112*b* is similar to the operation of discharging sheets onto the first stacker tray 112*a*, and thus a duplicated explanation thereof is omitted.

The first and second stacker trays 112*a* and 112*b* are supported by supporting members (not shown) configured to be movable up and down. By lowering a supporting member corresponding to the first or second stacker tray 112*a* or 112*b* down to a level below the supporting plane of the dolly 120, it is possible to transfer the first or second stacker tray 112*a* or 112*b* to the dolly 120.

The dolly 120 has, as shown in FIG. 10, casters 125 and a handle 126 so that the first stacker tray 112*a* and/or the second stacker tray 112*b* on which sheets are fully stacked can be conveyed to the outside of the stacker. The handle 126 allows a user to easily carry a large number sheets SA, at a time, that are stacked on the first stacker tray 112*a* and/or the second stacker tray 112*b*.

After the first stacker tray 112*a* and/or the second stacker tray 112*b* are transferred to the dolly 120, the first stacker tray 112*a* and/or the second stacker tray 112*b* are fixed with fixing members such as pins (not shown) provided on the upper surface of the dolly 120. Thereafter, the dolly 120 on which a large number of sheets SA are stacked is drawn from the stacker 100, and the stacked sheets SA are removed from the first stacker tray 112*a* and/or the second stacker tray 112*b* put on the dolly 120.

After the sheets SA are removed, the dolly 120 and the first stacker tray 112*a* and/or the second stacker tray 112*b* are again set in the stacker 100.

In the present embodiment, after the dolly 120 is drawn out, if either one of the first and second stacker trays 112*a* and 112*b* is detected to be set in the stacker 100, the stacker control unit 210 may operate the stacker 100. This allows an increase in operation time of the stacker 100.

In this state, if the dolly 120 and the first and second stacker trays 112*a* and 112*b* are set in the stacker 100, the setting thereof is detected by the dolly setting sensor 181 (see FIG. 3) and the first and second stacker tray setting sensors 182*a* and 182*b* (see FIG. 3). In response to a detection signal output from these sensors, the CPU 170 of the stacker control unit 210 raises the first and second stacker trays 112*a* and 112*b*. As a result, the first and second stacker trays 112*a* and 112*b* return to the above-described state shown in FIG. 4, and it becomes possible to stack new sheets.

In the present embodiment, when sheets are of a large size such as A3-size, sheets may be discharged to a combination of the first and second stacker trays 112*a* and 112*b* and stacked thereon. Next, an explanation is given below as to a specific example of a process of stacking large-size sheets on the combination of the first and second stacker trays 112*a* and 112*b*.

In this operation mode, the first and second stacker trays 112*a* and 112*b* are to be in their own home position or they are to be positioned such that the sheet stacking planes of the first and second stacker trays 112*a* and 112*b* are at the same height.

The CPU 170 performs a control operation such that before a sheet is conveyed, the sheet guide unit 115 is moved in the direction denoted by the arrow A in FIG. 4 to the waiting position located downstream of the second stacker tray 112*b* as seen in the sheet discharging direction.

In this state, a sheet fed out from the main body 901 of the image forming apparatus is conveyed to the sheet discharge roller pair 110 via the sheet conveying operation described above, and the sheet is stacked on the first and second stacker trays 112*a* and 112*b* via the sheet stacking operation described above. Thus, sheets are stacked one by one over the two stacker trays, i.e., the first and second stacker trays 112*a* and 112*b*.

Figure 11:
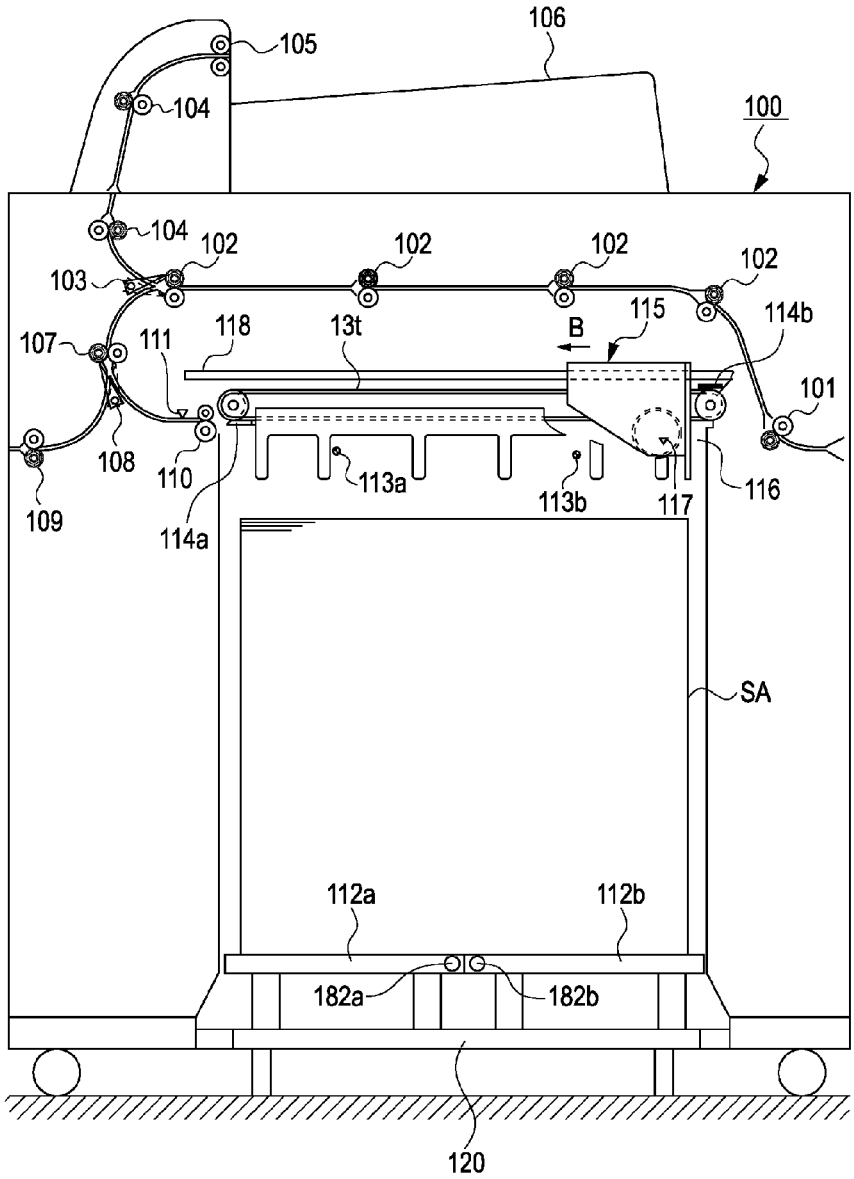
FIG. 11 is a diagram illustrating a stacker in a state in which first and second stacker trays with sheets fully stacked thereon are lowered down and put on a dolly.
Figure 12:
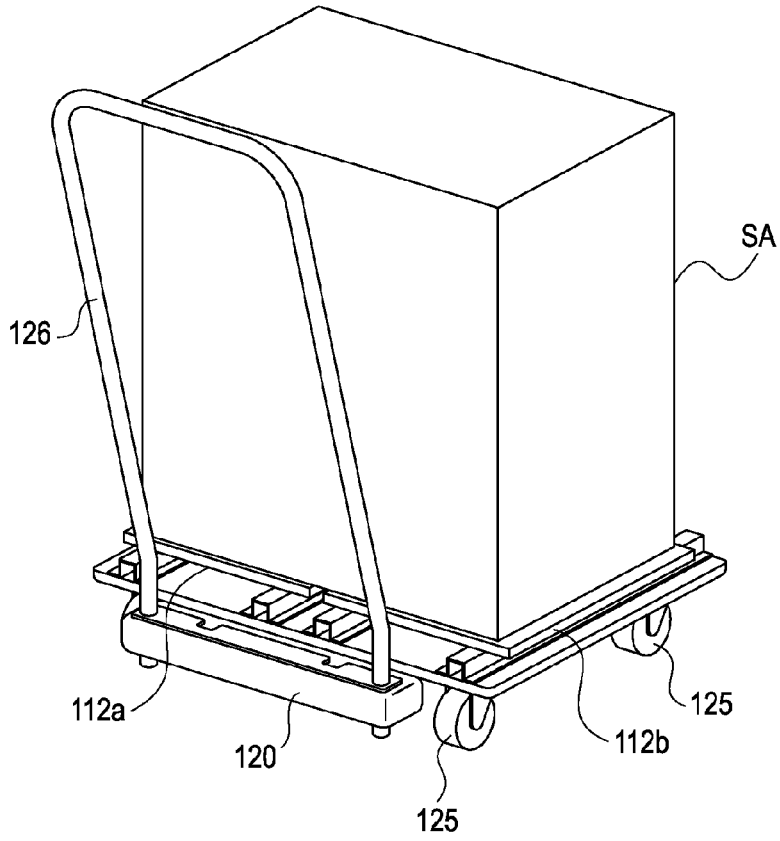
FIG. 12 is a perspective view illustrating a manner in which a stack of sheets is put on a dolly according to an embodiment of the present invention.

In the operation, if the first and second stacker trays 112*a* and 112*b* are detected to be fully loaded with stacked sheets, the stacker control unit 210 lowers the first and second stacker trays 112*a* and 112*b* simultaneously. As a result, as shown in FIGS. 11 and 12, the first and second stacker trays 112*a* and 112*b* are transferred onto the dolly 120.

In the example described above, the explanation has been given for the case in which the first and second stacker trays 112*a* and 112*b* are detected to be fully loaded with stacked sheets. When completion of a job including stacking sheets on the stacker trays 112*a* and 112*b* is detected, the stacker control unit 210 may lower the stacker trays 112*a* and 112*b* and may load the stacked sheets SA on the dolly 120.

The stacker trays 112*a* and 112*b* are controlled by the CPU 170 of the stacker control unit 210 as in the previous example.

In the example described above, the stacker control unit 210 is assumed to include a CPU to perform the control operation. However, the control operation may be performed in different manners. For example, hardware may be used to execute the control operation described above, or the CPU 211 may control the stacker control unit.

Figure 13B:
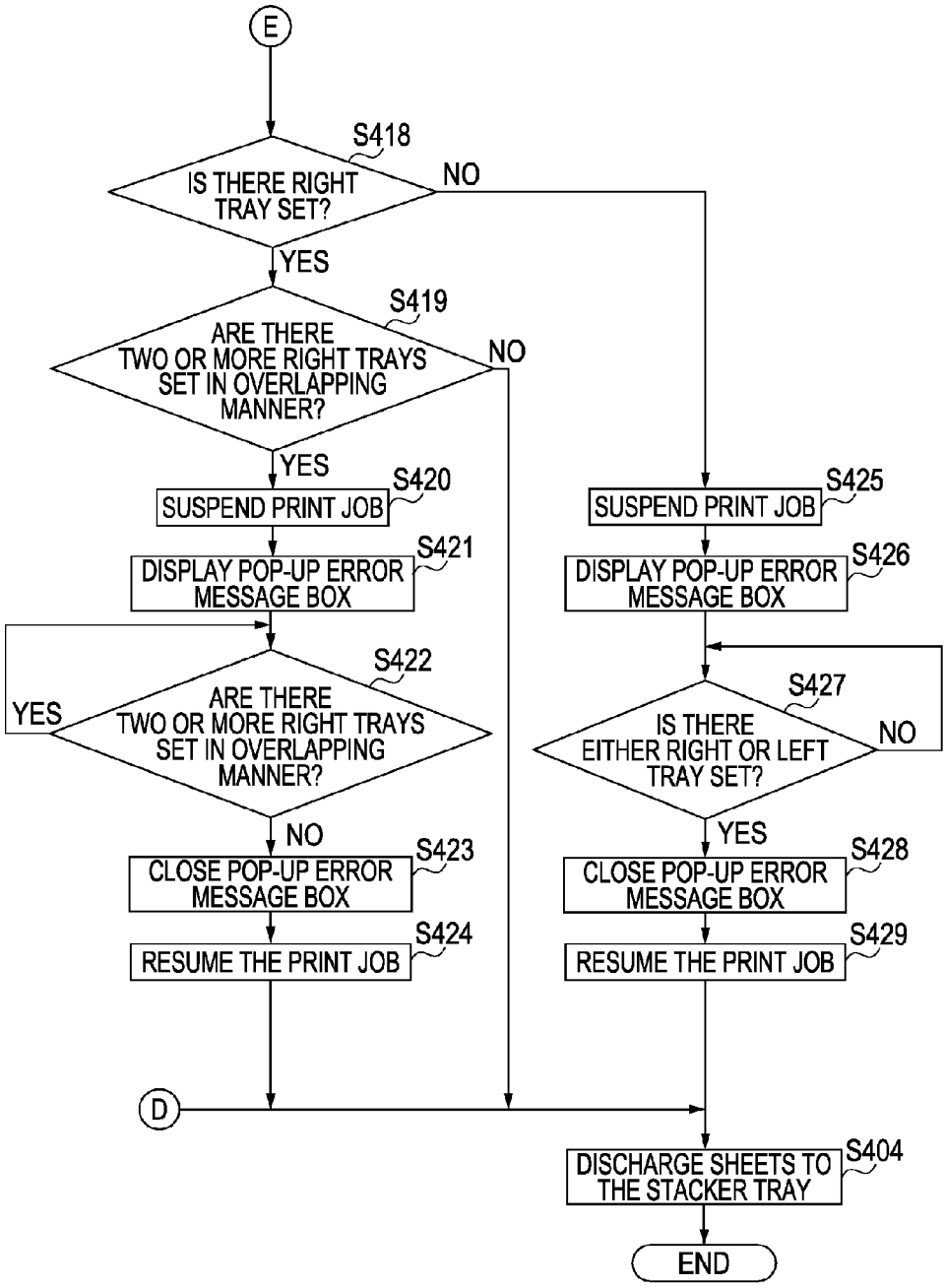
FIG. 13 is a flow chart illustrating a control procedure performed by an MFP control unit in terms of a print job including discharging sheets to a first or second stacker tray.

Next, an explanation is given below with reference to a flow chart shown in FIG. 13 as to a control procedure performed by the MFP control unit 206 in terms of a print job in which sheets are discharged to the first stacker tray 112*a* or the second stacker tray 112*b*. The process shown in the form of a flow chart in FIG. 13 is executed by the CPU 211 according to a program stored in the ROM 207.

If the electric power of the main part 901 of the image forming apparatus is turned on, then the CPU 211, in step S401, waits for receiving a command to discharge sheets to the first stacker tray 112*a* or the second stacker tray 112*b*. If the CPU 211 detects a command to discharge sheets to a specified stacker tray, i.e., the first stacker tray 112*a* or the second stacker tray 112*b*, the CPU 211 advances the process to step S402. In step S402, the CPU 211 acquires the status information of the stacker 100 from the CPU 170 in terms of whether the first stacker tray 112*a* or the second stacker tray 112*b* is set on the stack unit 112. The details of the process of acquiring the status information of the stacker 100 have already been described above with reference with FIG. 5.

The CPU 211 then advances the process to step S403. In step S403, the CPU 211 checks the home position sensors 113*a* and 113*b* to determine whether first and second stacker trays 112*a* and 112*b* are set on the stack unit 112. In a case where the determination is that first and second stacker trays 112*a* and 112*b* are set on the stack unit 112, the CPU 211 controls the image forming apparatus 900 to perform a printing operation, and the CPU 211 advances the process to step S404. In step S404, sends a command to the CPU 170 to discharge a sheet to the first stacker tray 112*a* or the second stacker tray 112*b*.

In a case where the CPU 211 determines that either the first stacker tray 112*a* or the second stacker tray 112*b* is not set on the stack unit 112, the CPU 211 advances the process to step S405 and determines whether the command is to discharge a large-size sheet such as an A3-size sheet. In a case where it is determined that the command is to discharge a large-size sheet such as an A3-size sheets, the CPU 211 advances the process to step S406 and suspends the print job.

Figure 14:
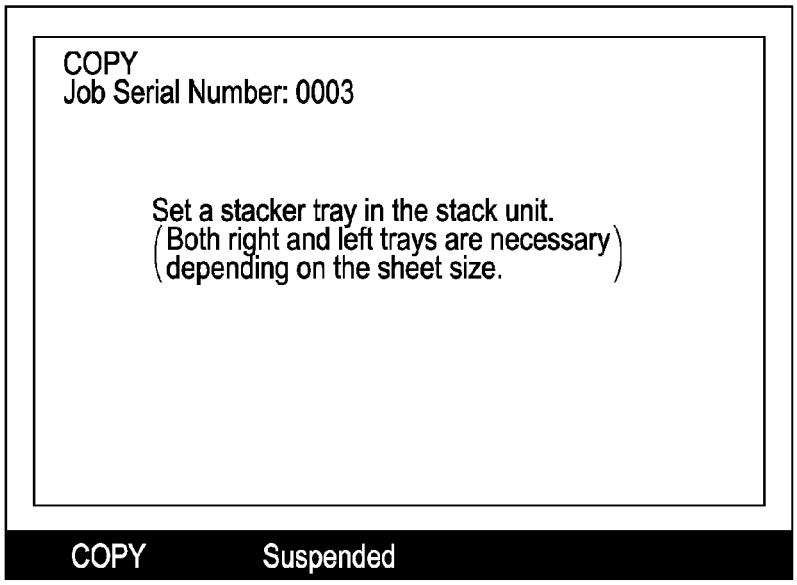
FIG. 14 is a diagram illustrating an example of a pop-up error dialog box displayed on an operation unit according to an embodiment of the present invention.

The CPU 211 advances the process to step S407 and displays a pop-up error dialog box such as that shown in FIG. 14 on the operation unit 209.

The CPU 211 then advances the process to step S408. In step S408 the CPU 211 checks the home position sensors 113*a* and 113*b* to determine whether first and second stacker trays 112*a* and 112*b* are set on the stack unit 112. In a case where the determination is that first and second stacker trays 112*a* and 112*b* are set on the stack unit 112, the CPU 211 advances the process to step S409.

In step S409, the CPU 211 closes the pop-up error dialog box displayed on the operation unit 209 and resumes the suspended print job. Thereafter, in step S404, the CPU 211 sends a command to the CPU 170 to discharge a large-size sheet over the first and second stacker trays 112*a* and 112*b*.

On the other hand, in a case where the determination in step S405 is that the command is not a command to discharge a large-size sheet such as an A3-size sheet, i.e., the command is a command to discharge a small-size sheet such as an A4-size sheet, the CPU 211 advances the process to step S411. In step S411, the CPU 211 checks the home position sensor 113*a* to determine whether a first stacker tray 112*a* is set on the stack unit 112.

In a case where the determination is that a first stacker tray 112*a* is set on the stack unit 112, the CPU 211 advances the process to step S412. In step S412, the CPU 211 checks the home position sensor 113*a* (or the sheet surface detection sensor 117) and the first stacker tray setting sensor 182*a* to determine whether a plurality of stacker trays are set in a vertically overlapping manner in the stack unit 112. If a stacker tray is detected by both the home position sensor 113*a* and the first stacker tray setting sensor 182*a*, the CPU 211 determines that two stacker trays are set by mistake in a wrong manner. On the other hand, in a case where a stacker tray is detected by only either one of the home position sensor 113*a* (or the sheet surface detection sensor 117) and the first stacker tray setting sensor 182*a*, the CPU 211 determines that the stacker tray is correctly set. By using the home position sensor 113*a* or the sheet surface detection sensor 117, it is possible to detect the location in a vertical direction (i.e., height) of the stacker tray set in the stacker 100. Each stacker tray setting sensor is capable of detecting, at the stacker tray taking-out position, whether a stacker tray is set. When stacker trays are detected at different locations at the same time, it is determined that stacker trays are set by mistake in a wrong manner.

In a case where the determination is that a plurality of first stacker trays 112*a* are not set in a vertically overlapping manner in the stack unit 112, the CPU 211 advances the process to step S404 and sends a command to the CPU 170 to discharge a small-size sheet onto the first stacker tray 112*a*.

On the other hand, in a case whether the determination is that a plurality of first stacker trays 112*a* are set in a vertically overlapping manner in the stack unit 112, the CPU 211 advances the process to step S413 to suspend the print job.

Figure 15:
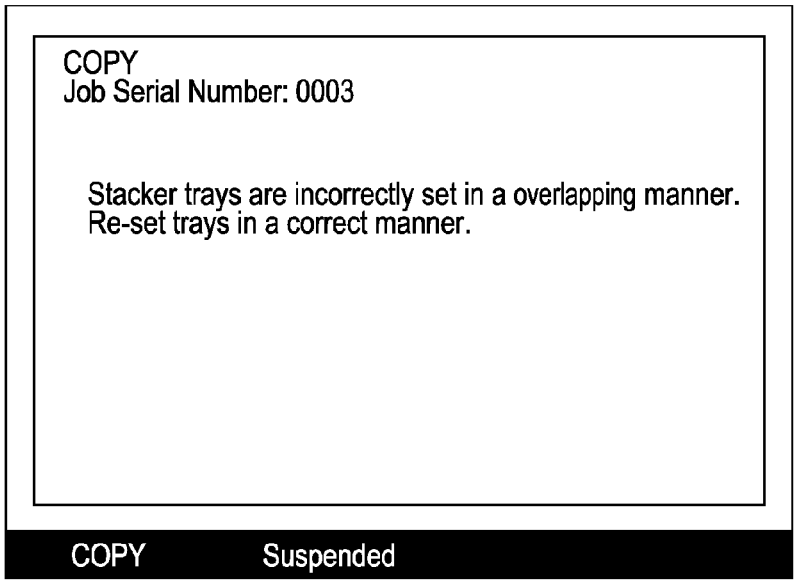
FIG. 15 is a diagram illustrating an example of a pop-up error dialog box displayed on an operation unit according to an embodiment of the present invention.

The CPU 211 then advances the process to step S414. In step S414, the CPU 211 displays a pop-up error dialog box such as that shown in FIG. 15 on the operation unit 209. The CPU 211 then advances the process to step S415 and checks the home position sensor 113*a* and the first stacker tray setting sensor 182*a* to determine whether a plurality of first stacker trays 112*a* are set in a vertically overlapping manner in the stack unit 112. In a case where the determination is that a plurality of first stacker trays 112*a* are not set in the vertically overlapping manner in the stack unit 112, the CPU 211 advances the process to step S416. In step S416, the CPU 211 closes the pop-up error dialog box displayed on the operation unit 209.

The CPU 211 advances the process to step S417 to resume the suspended print job. Thereafter, in step S404, the CPU 211 issues a command to discharge a small-size sheet to one of the first and second stacker trays 112*a* and 112*b*.

On the other hand, in a case where the determination is that the first stacker tray 112*a* is not set on the stack unit 112, the CPU 211 advances the process to step S418. In step S418, the CPU 211 checks the home position sensor 113*b* to determine whether the second stacker tray 112*b* is set on the stack unit 112. In a case where the determination is that the second stacker tray 112*b* is set on the stack unit 112, the CPU 211 advances the process to step S419. In step S419, the CPU 211 checks the home position sensor 113*b* and the second stacker tray setting sensor 182*b* to determine whether a plurality of second stacker trays 112*b* are set in the vertically overlapping manner in the stack unit 112. If the determination is that a plurality of second stacker trays 112*b* are not set in the vertically overlapping manner in the stack unit 112, the CPU 211 advances the process to step S404 and sends a command to the CPU 170 to discharge a small-size sheet to the second stacker tray 112*b*.

On the other hand, in a case whether the determination is that a plurality of second stacker trays 112*b* are set in the vertically overlapping manner in the stack unit 112, the CPU 211 advances the process to step S420 and suspends the print job.

Steps S421 to S424 are similar to steps S413 to S417 except for the location of the stacker tray, and thus an explanation thereof is omitted.

On the other hand, in a case where the determination is that the second stacker tray 112*b* is not set in the stack unit 112, the CPU 211 advances the process to step S425 and suspends the print job.

The CPU 211 then advances the process to step S426 and displays a pop-up error dialog box such as that shown in FIG. 14 on the operation unit 209.

The CPU 211 then advances the process to step S427. In step S427, using the home position sensors 113*a* and 113*b*, the CPU 211 checks whether either one of the first stacker tray 112*a* and the second stacker tray 112*b* is set in the stack unit 112. In a case where the CPU 211 determines that either one of the first stacker tray 112*a* and the second stacker tray 112*b* is set in the stack unit 112, the CPU 211 advances the process to step S428.

In step S428, the CPU 211 closes the pop-up error dialog box displayed on the operation unit 209.

The CPU 211 then advances the process to step S429 to resume the suspended print job. Thereafter, in step S404, the CPU 211 sends to the CPU 170 a command to discharge a small-size sheet to either the first stacker tray 112*a* or the second stacker tray 112*b*.

In the example described above, when the CPU 170 detects the states of the stacker trays, the CPU 211 restricts the execution of the print job depending on the detected states. However, the operation may be controlled in different ways, as described below.

If the CPU 170 determines that the print job should be suspended, based on the results of the detection as to the state performed in steps S403, S405, S411, S412, S418, and S419, the execution of the print job may be restricted. Instead of suspending the print job, the operation may be controlled such that a sheet fed by an apparatus at an upstream location is not conveyed to a stacker tray. In this case, the resuming of the print job in steps S410, S417, S427, and S429 may be read as resuming of the conveying of a sheet.

In the present embodiment, as described above, even if a user puts, by mistake, a plurality of stacker trays in the vertically overlapping manner in the stack unit 112 of the stacker 100, the print job is suspended before a sheet is discharged to the stacker tray. This prevents a reduction in stacking efficiency of the stacker 100.

There is a possibility that in a state in which one of stacker trays is supported by a lift of the stacker 100, a user sets the dolly 120 with a stacker tray placed at a location that conflicts with the location of the former stacker tray. In this case, the execution of the print job is suspended and discharging of sheets is not performed. This prevents a collision from occurring between the lift that moves down as sheets are stacked, the former stacker tray, and the stacker tray disposed on the dolly 120.

In the embodiments of the present invention described above, the stacker control unit 210 is disposed in the stacker 100, and the stacker control unit 210 generally controls the operation of the stacker 100 by sending/receiving information to/from the MFP control unit 206 disposed in the main body 901 of the image forming apparatus. The stacker control unit 210 may be disposed integrally with the MFP control unit 206 in the controller 960 in the main body 901 of the image forming apparatus, and the controller 960 may directly control the operation of the stacker 100. In the embodiments described above, the stacker 100 is assumed to have two stacker trays. The stacker 100 may include three or more stacker trays.

In the embodiments described above, by way of example, it is assumed that the large size of sheets is the A3 size and the small size is the A4 size. The sheet sizes are not limited to those, but sheets that are greater than a predetermined size may be treated as large-size sheets that are discharged over a plurality of stacker trays, while sheets that are smaller than the predetermined size may be treated as small-size sheets that are discharged not over a plurality of stacker trays.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-321647 filed Dec. 17, 2008, which is hereby incorporated by reference herein in its entirety.

What is claimed is:

1. A sheet processing system comprising:

a plurality of removable stacking trays;

a stacking control unit configured to control sheets on which images are printed by a printing unit to be stacked on at least one of the plurality of removable stacking trays;

a detecting unit configured to detect that one of the plurality of removable stacking trays is superposed on another one of the plurality of removable stacking trays; and a notification unit configured to make a notification after the detecting unit detects that one of the plurality of removable stacking trays is superposed on another one of the plurality of removable stacking trays.

2. The sheet processing system according to claim 1, wherein a removable stacking tray is set in one of a plurality of stacking tray positions and can be moved up and down.

3. The sheet processing system according to claim 1, wherein the stacking control unit is configured to control sheets on which images are printed by the printing unit to be stacked by using a removable stacking tray set in any one of a plurality of stacking tray positions in a case where a size of the sheets is a first size, and control sheets on which images are printed by the printing unit to be stacked by using a plurality of removable stacking trays set in adjacent coplanar stacking tray positions in a case where a size of the sheets is a second size which is larger than the first size.

4. The sheet processing system according to claim 1, wherein the notification unit is configured to make the notification by causing a display unit to display an error notification screen.

5. A sheet processing system comprising:

a plurality of removable stacking trays;

a stacking control unit configured to control sheets on which images are printed by a printing unit to be stacked on at least one of the plurality of removable stacking trays; and a detecting unit configured to detect that one of the plurality of removable stacking trays is superposed on another one of the plurality of removable stacking trays;

wherein the stacking control unit is configured to control after the detecting unit detects that one of the plurality of removable stacking trays is superposed on another one of the plurality of removable stacking trays, sheets on which images are printed by the printing unit not to be stacked on the superposed removable stacking trays.

6. The sheet processing system according to claim 5, wherein a removable stacking tray is set in one of a plurality of stacking tray positions and can be moved up and down.

7. The sheet processing system according to claim 5, wherein the stacking control unit is configured to control sheets on which images are printed by the printing unit to be stacked by using any one of the plurality of removable stacking trays in a case where a size of the sheets is a first size, and control sheets on which images are printed by the printing unit to be stacked by using a plurality of adjacent coplanar removable stacking trays in a case where a size of the sheets is a second size which is larger than the first size.

8. The sheet processing system according to claim 5, further comprising a unit configured to control the printing unit to suspend printing of the images to the sheets.

9. A method for a sheet processing system including a plurality of removable stacking trays, the method comprising:

causing sheets on which images are printed by a printing unit to be stacked on at least one of the plurality of removable stacking trays;

detecting that one of the removable stacking trays is superposed on another one of the plurality of removable stacking trays; and making a notification in a case where it is detected that one removable stacking tray is superposed on another one of the plurality of removable stacking trays.

10. A method for a sheet processing system including a plurality of removable stacking trays, the method comprising:

causing sheets on which images are printed by a printing unit to be stacked on at least one of the plurality of removable stacking trays; and detecting that one of the removable stacking trays is superposed on another one of the plurality of removable stacking trays;

wherein, in a case where it is detected that one removable stacking tray is superposed on another one of the plurality of removable stacking trays, sheets on which images are printed by the printing unit are controlled not to be stacked on the superposed removable stacking trays.

11. A non-transitory computer readable storage medium containing computer-executable instructions for controlling a sheet processing system including a plurality of removable stacking trays, the computer-executable instructions being executed to:

control sheets on which images are printed by a printing unit to be stacked on at least one of the plurality of removable stacking trays;

detect that one of the removable stacking trays is superposed on another one of the plurality of removable stacking trays; and make a notification in a case where it is detected that one removable stacking tray is superposed on another one of the plurality of removable stacking trays.

12. A non-transitory computer readable storage medium containing computer-executable instructions for controlling a sheet processing system including a plurality of removable stacking trays, the computer-executable instructions being executed to:

control sheets on which images are printed by a printing unit to be stacked on at least one of the plurality of removable stacking trays; and detect that one removable stacking tray is superposed on another one of the plurality of removable stacking trays, wherein, in a case where it is detected that one of the removable stacking trays is superposed on another one of the plurality of removable stacking trays, sheets on which images are printed by the printing unit are controlled not to be stacked on the superposed removable stacking trays.

13. A sheet processing system comprising:

a stacking control unit configured to control sheets on which images are printed by a printing unit to be stacked on at least one of a plurality of removable stacking trays in a stacking tray unit;

a detecting unit configured to detect that a removable stacking tray is set in the stacking tray unit; and a notification unit configured to make a notification after the detecting unit detects that a second removable stacking tray is set in the stacking tray unit after a first removable stacking tray, wherein the first removable stacking tray and the second removable stacking tray are superposed in the stacking tray unit by setting the second removable stacking tray in the stacking tray unit.

14. The sheet processing system according to claim 13, wherein a removable stacking tray is set in one of a plurality of stacking tray positions in the stacking tray unit and can be moved up and down.

15. The sheet processing system according to claim 13, wherein the stacking control unit is configured to control sheets on which images are printed by the printing unit to be stacked by using a removable stacking tray set in any one of a plurality of stacking tray positions in the stacking tray unit in a case where a size of the sheets is a first size, and control sheets on which images are printed by the printing unit to be stacked by using a plurality of removable stacking trays set in adjacent coplanar stacking tray positions in the stacking tray unit in a case where a size of the sheets is a second size which is larger than the first size.

16. The sheet processing system according to claim 13, wherein the notification unit is configured to make the notification by causing a display unit to display an error notification screen.

* * * * *